US010182612B2

(12) United States Patent
Bunnell et al.

(10) Patent No.: US 10,182,612 B2
(45) Date of Patent: Jan. 22, 2019

(54) SOLE STRUCTURE FOR AN ARTICLE OF FOOTWEAR HAVING A NONLINEAR BENDING STIFFNESS WITH COMPRESSION GROOVES AND DESCENDING RIBS

(71) Applicant: Nike, Inc., Beaverton, OR (US)

(72) Inventors: Dennis D. Bunnell, Vancouver, WA (US); Bryan N. Farris, North Plains, OR (US); Alison Sheets-Singer, Portland, OR (US); Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 40 days.

(21) Appl. No.: 15/341,530

(22) Filed: Nov. 2, 2016

(65) Prior Publication Data

US 2017/0127755 A1 May 11, 2017

Related U.S. Application Data

(60) Provisional application No. 62/251,333, filed on Nov. 5, 2015.

(51) Int. Cl.
*A43C 15/16* (2006.01)
*A43B 13/14* (2006.01)
(Continued)

(52) U.S. Cl.
CPC ..... *A43B 13/141* (2013.01); *A43B 5/02* (2013.01); *A43B 13/04* (2013.01); *A43B 13/122* (2013.01);
(Continued)

(58) Field of Classification Search
CPC ... A43B 13/141; A43B 13/122; A43B 13/184; A43B 13/186; A43B 5/02
(Continued)

(56) References Cited

U.S. PATENT DOCUMENTS 2,201,300 A * 5/1940 Prue ..... A43B 9/00 12/142 F
2,379,139 A 6/1945 Flink
(Continued)

FOREIGN PATENT DOCUMENTS

DE 102012104264 A1 11/2013
EP 1483981 A1 12/2004
(Continued)

*Primary Examiner* — Ted Kavanaugh
(74) *Attorney, Agent, or Firm* — Quinn IP Law

(57) ABSTRACT

A sole structure for an article of footwear comprises a sole plate that has a foot-facing surface with a forefoot portion, and a ground-facing surface opposite from the foot-facing surface. The sole plate has a plurality of grooves extending at least partially transversely relative to the sole plate in the forefoot portion of the foot-facing surface, and a plurality of ribs protruding at the ground-facing surface, extending at least partially transversely relative to the sole plate, and underlying the plurality of grooves. At least some grooves of the plurality of grooves are configured to be open when the sole structure is dorsiflexed in a first portion of a flexion range, and closed when the sole structure is dorsiflexed in a second portion of the flexion range that includes flex angles greater than in the first portion of the flexion range.

20 Claims, 15 Drawing Sheets

(51) Int. Cl.

| | |
|---|---|
| ***A43B 5/02*** | (2006.01) |
| ***A43B 13/04*** | (2006.01) |
| ***A43B 13/12*** | (2006.01) |
| ***A43B 13/18*** | (2006.01) |
| ***A43B 13/22*** | (2006.01) |

(52) U.S. Cl.
CPC ..... *A43B 13/184* (2013.01); *A43B 13/186* (2013.01); *A43B 13/188* (2013.01); *A43B 13/223* (2013.01); *A43C 15/16* (2013.01)

(58) Field of Classification Search
USPC ..... 36/102
See application file for complete search history.

(56) References Cited

U.S. PATENT DOCUMENTS

| | | | | |
|---|---|---|---|---|
| 4,498,251 | A * | 2/1985 | Shin | A43B 5/06 36/30 R |
| 4,507,879 | A * | 4/1985 | Dassler | A43B 5/02 36/102 |
| 4,658,514 | A * | 4/1987 | Shin | A43B 5/06 36/30 R |
| 4,779,361 | A | 10/1988 | Kinsaul | |
| 7,513,065 | B2 | 4/2009 | Kita et al. | |
| 8,365,444 | B2 | 2/2013 | Youngs | |
| 8,656,613 | B2 * | 2/2014 | Stockbridge | A43B 13/00 36/102 |
| 2003/0033730 | A1 * | 2/2003 | Burke | A43B 7/142 36/25 R |
| 2005/0039350 | A1 | 2/2005 | Hung | |
| 2007/0039208 | A1 | 2/2007 | Bove et al. | |
| 2014/0250723 | A1 * | 9/2014 | Kohatsu | A43B 3/26 36/88 |
| 2015/0089841 | A1 | 4/2015 | Smaldone et al. | |
| 2017/0079374 | A1 | 3/2017 | Farris et al. | |
| 2017/0079375 | A1 | 3/2017 | Bunnell et al. | |
| 2017/0079376 | A1 | 3/2017 | Bunnell et al. | |
| 2017/0079378 | A1 | 3/2017 | Farris et al. | |

FOREIGN PATENT DOCUMENTS

| | | | |
|---|---|---|---|
| FR | 892219 | A | 3/1944 |
| FR | 2974482 | A1 | 11/2012 |
| WO | 2006087737 | A1 | 8/2006 |
| WO | 2011005728 | A1 | 1/2011 |

* cited by examiner

SOLE STRUCTURE FOR AN ARTICLE OF FOOTWEAR HAVING A NONLINEAR BENDING STIFFNESS WITH COMPRESSION GROOVES AND DESCENDING RIBS

CROSS-REFERENCE TO RELATED APPLICATION

This application claims the benefit of priority to U.S. Provisional Application No. 62/251,333, filed on Nov. 5, 2015, which is hereby incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are configured to provide desired cushioning, motion control, and resiliency.

DESCRIPTION

Figure 1:
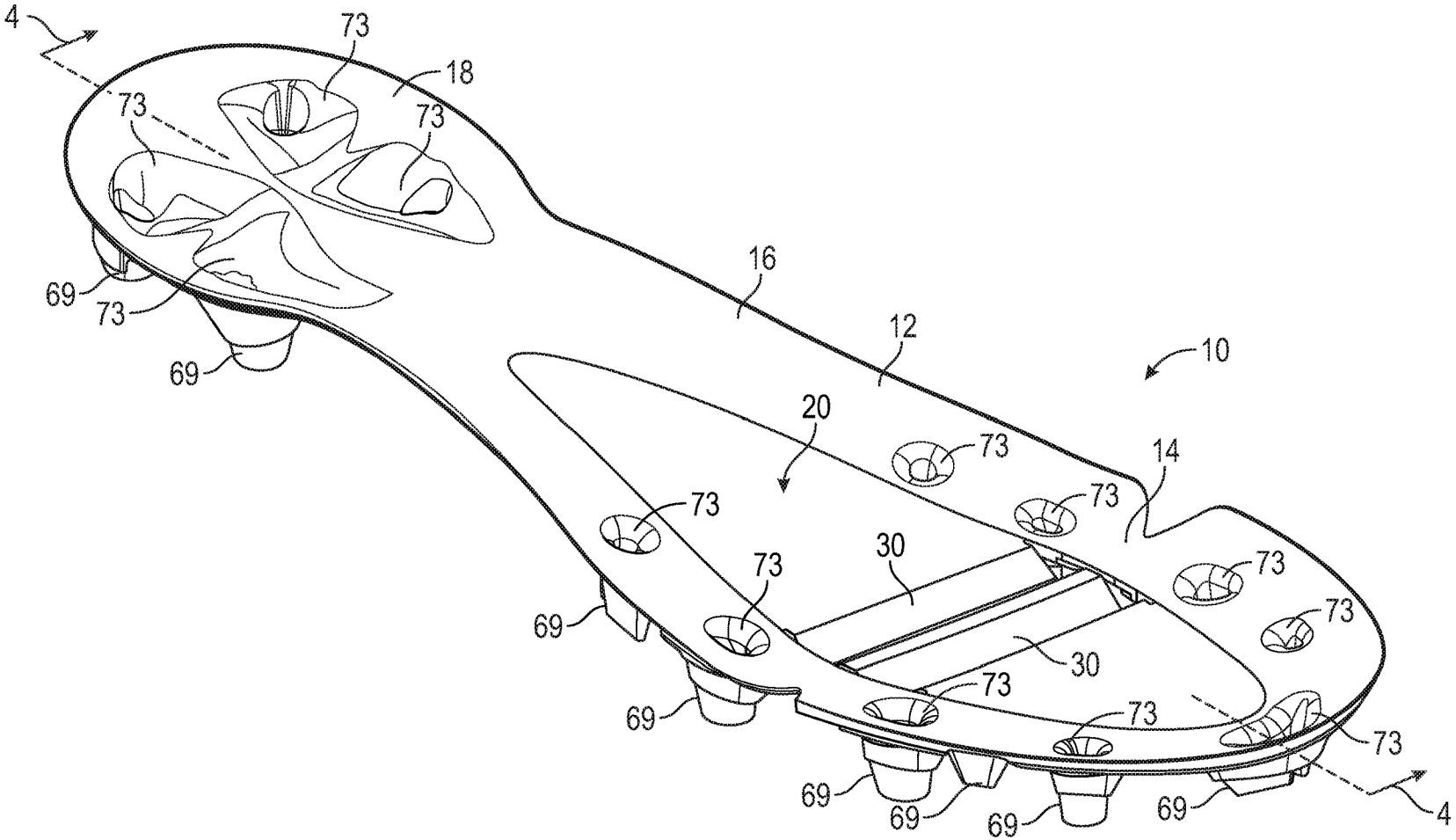
FIG. 1 is a schematic illustration in perspective view of an embodiment of a sole structure for an article of footwear in an unflexed position.

A sole structure for an article of footwear comprises a sole plate that has a foot-facing surface with a forefoot portion, and a ground-facing surface opposite from the foot-facing surface. The sole plate has a plurality of grooves extending at least partially transversely relative to the sole plate in the forefoot portion of the foot-facing surface. The sole plate also has a plurality of ribs protruding at the ground-facing surface. The ribs extend at least partially transversely relative to the sole plate, and underlie the plurality of grooves. For example, each rib of the plurality of ribs may be coincident with a different respective groove of the plurality of grooves.

At least some of the grooves are configured to be open when the forefoot portion of the sole structure is dorsiflexed in a first portion of a flexion range, and closed when the sole structure is dorsiflexed in a second portion of a flexion range that includes flex angles greater than in the first portion of the flexion range. For example, each of the grooves may have at least a predetermined depth and a predetermined width configured so that each of the grooves is open when the forefoot portion is dorsiflexed in the first portion of the flexion range. The grooves are "closed" either when the adjacent walls at the grooves contact one another, or, if resilient material is disposed in the grooves, as the resilient material reaches a fully compressed state under the compressive forces.

The first portion of the flexion range includes flex angles less than a first predetermined flex angle. The second portion of the flexion range includes flex angles greater than or equal to the first predetermined flex angle. The sole structure has a change in bending stiffness at the first predetermined flex angle, and the sole structure may be indicated as having a nonlinear bending stiffness. The sole plate has a resistance to deformation in response to compressive forces applied across the plurality of grooves when the grooves are closed. In an embodiment, the first predetermined flex angle is an angle selected from the range of angles extending from 35 degrees to 65 degrees.

Additionally the sole plate may have at least one flexion channel that extends at least partially transversely relative to the sole plate at the ground-facing surface of the sole plate between an adjacent pair of ribs of the plurality of ribs. The grooves, the ribs, and the at least one flexion channel increase flexibility of the forefoot portion of the sole plate at flex angles less than the first predetermined flex angle.

The plurality of ribs may protrude at the ground-facing surface further than both a portion of the sole plate forward of the plurality of ribs and a portion of the sole plate rearward of the plurality of ribs. A depth of each groove of the plurality of grooves may be greater than or equal to a thickness of the portion of the sole plate forward of the plurality of ribs and the portion of the sole plate rearward of the plurality of ribs. Accordingly, in such an embodiment, the descending ribs enable the greater depth of the grooves. The ribs thus permit greater options in configuring the sole plate in order to provide a desired change in bending stiffness at a first predetermined flex angle.

In another embodiment, the plurality of ribs protrude at the ground-facing surface no further than both a portion of the sole plate forward of the plurality of ribs and a portion of the sole plate rearward of the plurality of ribs when the sole plate is in an unflexed position. In such an embodiment, a depth of each groove of the plurality of grooves is less than a thickness of the portion of the sole plate forward of the plurality of ribs and is less than a thickness of the portion of the sole plate rearward of the plurality of ribs.

Additionally, the angle of adjacent walls of the sole plate at each groove of the plurality of grooves can be configured to affect the first predetermined flex angle. In an embodiment, adjacent walls of the sole plate at each groove include a front wall inclining in a forward direction, and a rear wall inclining in a rearward direction when the sole plate is unflexed in a longitudinal direction of the sole plate. In another embodiment, adjacent walls of the sole plate at each of the grooves include a front wall and a rear wall that is parallel with the front wall when the sole plate is unflexed in the longitudinal direction.

The grooves may each include a medial end and a lateral end, and each groove may have a length that extends straight between the medial end and the lateral end. The lateral end may be rearward of the medial end so that the grooves generally underlie the metatarsal-phalangeal joints which are typically further rearward near the lateral side of the foot than near the medial side of the foot.

The sole plate may be a variety of materials including but not limited to a thermoplastic elastomer, such as but not limited to thermoplastic polyurethane (TPU), a glass composite, a nylon, such as a glass-filled nylon, a spring steel, carbon fiber, ceramic or a foam or rubber material, such as but not limited to a foam or rubber with a Shore A Durometer hardness of about 50-70 (using ASTM D2240-05(2010) standard test method) or an Asker C hardness of 65-85 (using hardness test JIS K6767 (1976)). Additionally, different portions of the sole plate can be different materials. For example, in an embodiment, the sole plate includes a first portion that includes the plurality of grooves and the plurality of ribs, and a second portion surrounding a perimeter of the first portion. The first portion is a first material with a first bending stiffness, and the second portion is a second material with a second bending stiffness different than the first bending stiffness. For example, the second portion may be over-molded on or co-injection molded with the first portion.

The sole plate may have various features that help ensure that the bending stiffness in the forefoot portion is influenced mainly by the grooves. For example, the sole plate may include a first notch in a medial edge of the sole plate and a second notch in a lateral edge of the sole plate, with the first and the second notches aligned with the plurality of grooves. Additionally, the sole plate may include a first slot extending through the sole plate between a medial edge of the sole plate and the plurality of grooves, and a second slot extending through the sole plate between a lateral edge of the sole plate and the plurality of grooves. Each groove of the plurality of grooves may extend from the first slot to the second slot.

In an embodiment, a resilient material is disposed in at least one groove of the plurality of grooves such that the resilient material is compressed between adjacent walls of the sole plate at the at least one groove by the closing of the at least one groove as the sole structure is dorsiflexed. The bending stiffness of the sole structure in the first portion of the flexion range is thereby at least partially determined by a compressive stiffness of the resilient material. The resilient material may be but is not limited to polymeric foam. In an embodiment with relatively wide grooves, the resilient material compresses during the first range of flexion to a maximum compressed state under the compressive forces at the first predetermined flex angle. Accordingly, the plurality of grooves containing the resilient material are closed at the first predetermined flex angle even though the adjacent walls of the grooves are not in contact with one another, because with no further compression of the resilient material, any further bending of the sole structure is dependent upon the bending stiffness of the material of the sole plate.

In various embodiments, the sole plate may be any of a midsole, a portion of a midsole, an outsole, a portion of an outsole, an insole, a portion of an insole, a combination of an insole and a midsole, a combination of a midsole and an outsole, or a combination of an insole, a midsole, and an outsole. For example, the sole plate may be an outsole, a combination of a midsole and an outsole, or a combination of an insole, a midsole, and an outsole, and traction elements may protrude downward at the ground-facing surface of the sole plate further than the plurality of ribs.

In an embodiment, the sole plate is a first sole plate and the sole structure further comprises a second sole plate underlying the ground-facing surface of the first sole plate. The second sole plate has a surface with a recess facing the ground-facing surface of the first sole plate. The plurality of ribs of the first sole plate extends into the recess. In such an embodiment, for example, the first sole plate may be an insole plate, and the second sole plate may be an outsole plate.

In another embodiment, the sole plate is a first sole plate, the plurality of grooves is a first plurality of grooves, and at least some of the grooves of the first plurality of grooves close at the first predetermined flex angle. The sole structure further comprises a second sole plate underlying the ground-facing surface of the first sole plate. The second sole plate includes a foot-facing surface with a forefoot portion, and a ground-facing surface opposite the foot-facing surface. A second plurality of grooves extends at least partially transversely relative to the sole plate in the forefoot portion of the foot-facing surface. A second plurality of ribs protrudes at the ground-facing surface of the second sole plate, extends at least partially transversely relative to the sole plate, and underlies the second plurality of grooves. At least some grooves of the second plurality of grooves are configured to be open when the sole structure is dorsiflexed at flex angles less than a second predetermined flex angle, and closed when the sole structure is dorsiflexed at flex angles greater than or equal to the second predetermined flex angle. The second sole plate has a resistance to deformation in response to compressive forces applied across the second plurality of grooves, and the sole structure thereby has a change in bending stiffness at the second predetermined flex angle. The bending stiffness of the first sole plate may be different than the bending stiffness of the second sole plate.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the views, FIG. 1 shows a sole structure 10 for an article of footwear. The sole structure 10 may be for an article of footwear that is athletic footwear, such as football, soccer, or cross-training shoes, or the footwear may be for other activities, such as but not limited to other athletic activities. Embodiments of the footwear that include the sole structure 10 generally also include an upper, with the sole structure coupled to the upper. The sole structure 10 includes a sole plate 12 and has a nonlinear bending stiffness that increases with increasing flexion of a forefoot portion 14 in a longitudinal direction of the sole plate 12 (i.e., dorsiflexion). As further explained herein, the sole structure 10 has grooves 30 and descending ribs 41. The grooves provide a change in bending stiffness of the sole structure 10 when the sole structure 10 is flexed in the longitudinal direction at a predetermined flex angle. More particularly, the sole structure 10 has a bending stiffness that is a piecewise function with a change at a first predetermined flex angle. The bending stiffness is tuned by the selection of various structural parameters discussed herein that determine the first predetermined flex angle. As used herein, "bending stiffness" and "bend stiffness" may be used interchangeably.

Figure 3:
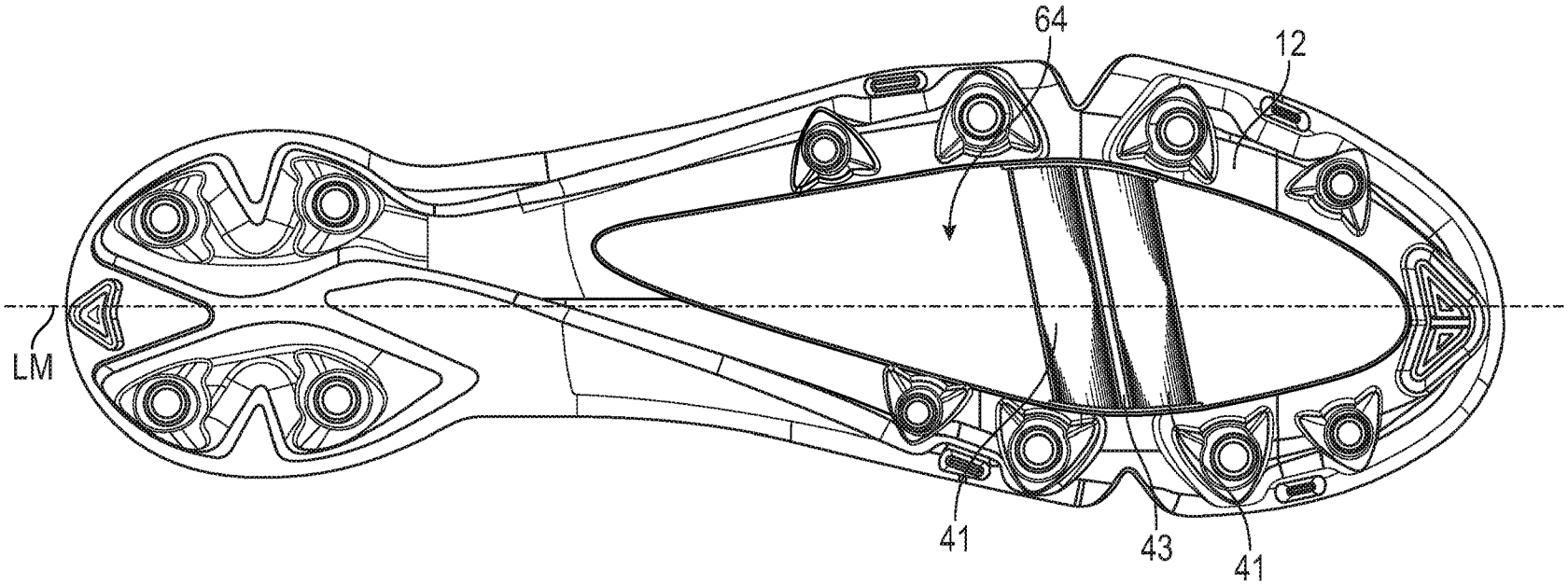
FIG. 3 is a schematic illustration in bottom view of the sole structure of FIG. 1.
Figure 4:
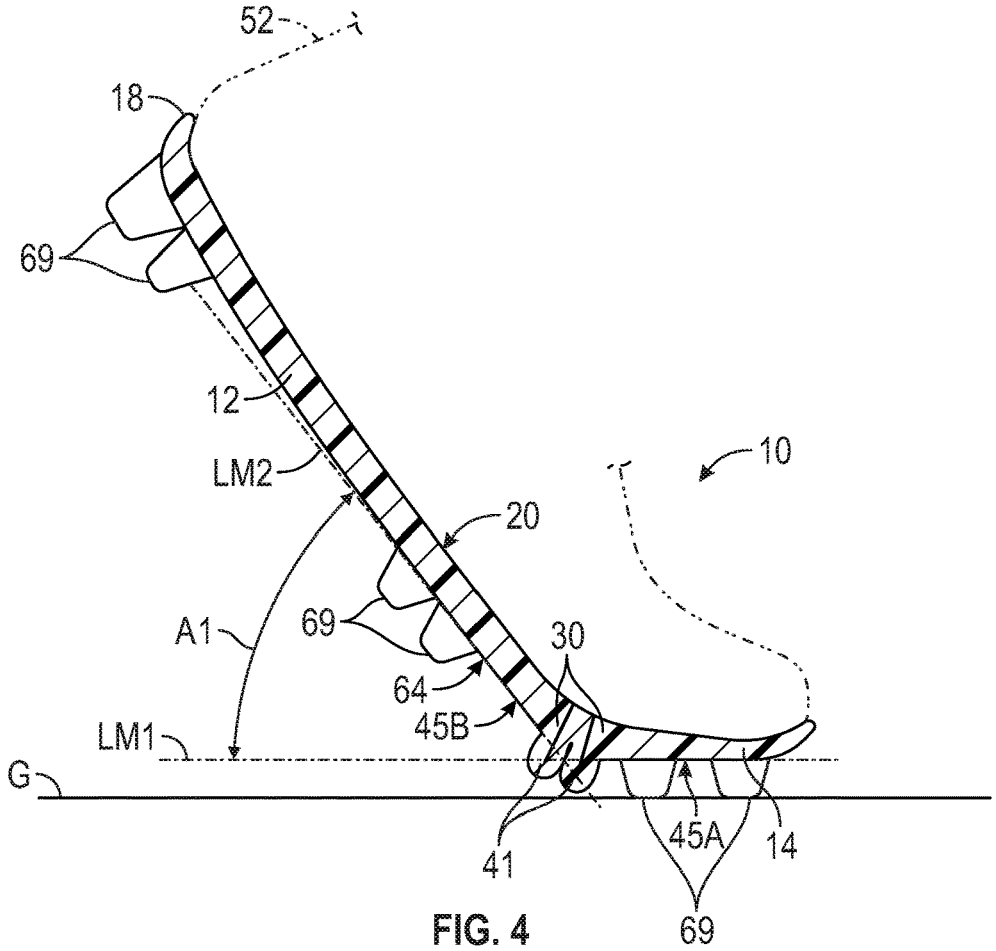
FIG. 4 is a schematic cross-sectional illustration of the sole structure of FIG. 1 taken at lines 4-4 in FIG. 1 and flexed at a first predetermined flex angle.

The first predetermined flex angle A1, shown in FIG. 4, is defined as the angle formed at the intersection between a first axis LM1 and a second axis LM2 where the first axis generally extends along a longitudinal midline LM of the sole plate 12 at a ground-facing surface 64 of sole plate 12 (best shown in FIG. 3) anterior to the grooves 30, and the second axis LM2 generally extends along the longitudinal midline LM at the ground-facing surface 64 of the sole plate 12 posterior to the grooves 30. The sole plate 12 is configured so that the intersection of the first and second axes LM1 and LM2 will typically be approximately centered both longitudinally and transversely below the grooves 30 discussed herein, and below the metatarsal-phalangeal joints of the foot 52 supported on the foot-facing surface 20. By way of non-limiting example, the first predetermined flex angle A1 may be from about 30 degrees (°) to about 65°. In one exemplary embodiment, the first predetermined flex angle A1 is found in the range of between about 30° and about 60°, with a typical value of about 55°. In another exemplary embodiment, the first predetermined flex angle A1 is found in the range of between about 15° and about 30°, with a typical value of about 25°. In another example, the first predetermined flex angle A1 is found in the range of between about 20° and about 40°, with a typical value of about 30°. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 650. Generally, the specific flex angle or range of angles at which a change in the rate of increase in bending stiffness occurs is dependent upon the specific activity for which the article of footwear is designed.

Figure 2:
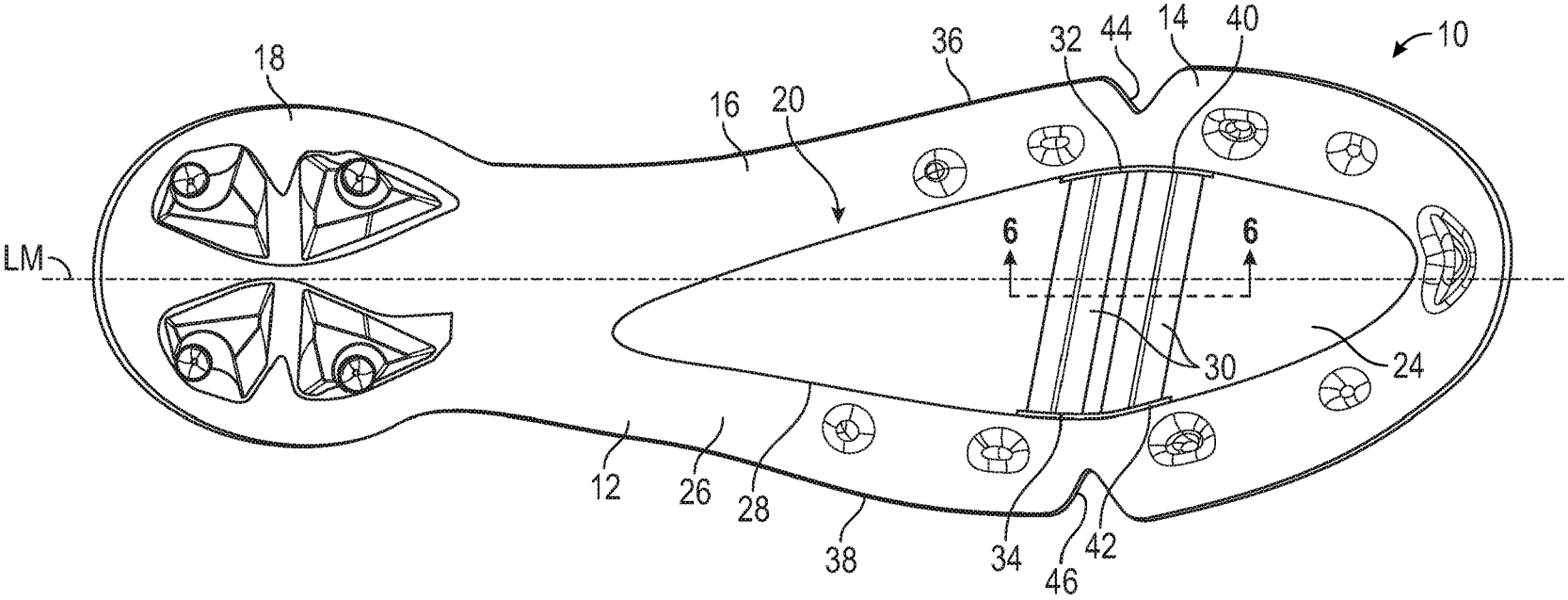
FIG. 2 is a schematic illustration in plan view of the sole structure of FIG. 1.

In the embodiment shown, the sole plate 12 is a full-length, unitary sole plate 12 that has a forefoot portion 14, a midfoot portion 16, and a heel portion 18 as best shown in FIG. 2. The sole plate 12 provides a foot-facing surface 20 (also referred to herein as a foot-receiving surface, although the foot need not rest directly on the foot-receiving surface) that extends over the forefoot portion 14, the midfoot portion 16, and the heel portion 18.

The heel portion 18 generally includes portions of the sole plate 12 corresponding with rear portions of a human foot 52, including the calcaneus bone, when the human foot is supported on the sole structure 10 and is a size corresponding with the sole structure 10. The forefoot portion 14 generally includes portions of the sole plate 12 corresponding with the toes and the joints connecting the metatarsals with the phalanges of the human foot 52 (interchangeably referred to herein as the "metatarsal-phalangeal joints" or "MPJ" joints). The midfoot portion 16 generally includes portions of the sole plate 12 corresponding with an arch area of the human foot 52, including the navicular joint. The forefoot portion, the midfoot portion, and the heel portion may also be referred to as a forefoot region, a midfoot region, and a heel region, respectively. As used herein, a lateral side of a component for an article of footwear, including a lateral edge 38 of the sole plate 12, is a side that corresponds with an outside area of the human foot 52 (i.e., the side closer to the fifth toe of the wearer). The fifth toe is commonly referred to as the little toe. A medial side of a component for an article of footwear, including a medial edge 36 of the sole plate 12, is the side that corresponds with an inside area of the human foot 52 (i.e., the side closer to the hallux of the foot of the wearer). The hallux is commonly referred to as the big toe.

The term "longitudinal," as used herein, refers to a direction extending along a length of the sole structure, i.e., extending from a forefoot portion to a heel portion of the sole structure. The term "transverse," as used herein, refers to a direction extending along a width of the sole structure, e.g., from a lateral side to a medial side of the sole structure. The term "transverse" as used herein, refers to a direction extending along a width of the sole structure, i.e., extending from a medial edge of the sole plate to a lateral edge of the sole plate. The term "forward" is used to refer to the general direction from the heel portion toward the forefoot portion, and the term "rearward" is used to refer to the opposite direction, i.e., the direction from the forefoot portion toward the heel portion. The term "anterior" is used to refer to a front or forward component or portion of a component. The term "posterior" is used to refer to a rear or rearward component of portion of a component. The term "plate" refers to a generally horizontally-disposed member generally used to provide structure and form rather than cushioning. A plate can be but is not necessarily flat and need not be a single component but instead can be multiple interconnected components. For example, a sole plate may be pre-formed with some amount of curvature and variations in thickness when molded or otherwise formed in order to provide a shaped footbed and/or increased thickness for reinforcement in desired areas. For example, the sole plate could have a curved or contoured geometry that may be similar to the lower contours of the foot.

As shown in FIG. 4, a foot 52 can be supported by the foot-facing surface 20, with the foot 52 above the foot-facing surface 20. The cross-sectional view of FIG. 4 is taken along the longitudinal midline LM of FIG. 3. The foot-facing surface 20 may be referred to as an upper surface of the sole plate 12. In the embodiment shown, the sole plate 12 is an outsole. In other embodiments within the scope of the present teachings, the sole plate may be an insole plate, also referred to as an inner board plate, an inner board, or an insole board. Still further, the sole plate may be a midsole plate or a unisole plate. Optionally, in the embodiment shown, an insole plate, or other layers of the article of footwear may overlay the foot-facing surface 20 and be positioned between the foot 52 and the foot-facing surface 20.

Figure 7:
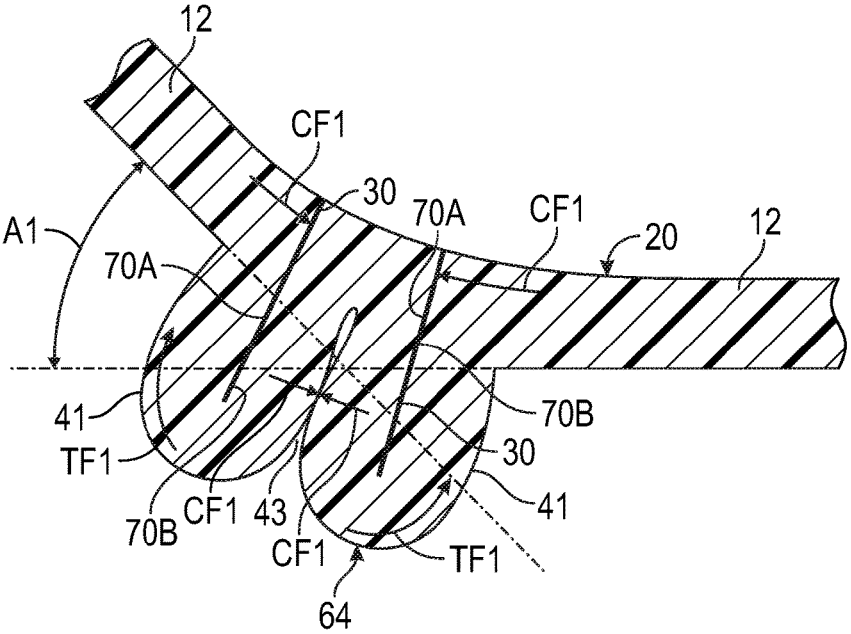
FIG. 7 is a schematic cross-sectional illustration in fragmentary view of the sole structure of FIG. 6 flexed at the first predetermined flex angle.

The sole plate 12 has a plurality of grooves 30 that affect the bending stiffness of the sole structure 10. More specifically, the grooves 30 are configured to be open at flex angles less than a first predetermined flex angle A1 (indicated in FIGS. 4 and 5) and to be closed at flex angles greater than or equal to the first predetermined flex angle A1. With the grooves 30 closed, compressive forces CF1 on the sole plate 12 are applied across the closed grooves 30, as shown in FIG. 7. The sole plate 12 at the closed grooves 30 has a resistance to deformation thus increasing the bending stiffness of the sole structure 10 when the grooves 30 close.

In the embodiment of FIG. 4, the grooves 30 are all open at flex angles less than the first predetermined flex angle, and are all closed at the flex angle A1. Alternatively, different ones of the grooves 30 could be different sizes with adjacent walls forming different angles relative to one another, so that the different grooves close at different flex angles. Generally, if the grooves 30 are empty, i.e., do not have resilient material or any other members disposed therein between the adjacent walls, then the groove closes when the adjacent walls contact one another. Accordingly, when the grooves are empty and are all of the same size, then the first predetermined flex angle is the sum of the angles between the walls of each of the grooves. If a resilient material is in the space between the walls, then the grooves close when the resilient material reaches a maximum compressed state under the magnitude of the compressive forces, and the adjacent walls of the grooves are not in contact when the groove is closed. Accordingly, in such an embodiment, the first predetermined flex angle is less than the first predetermined flex angle in an embodiment in which the grooves are empty, and is a function of the compressibility of the resilient material. A person of ordinary skill in the art can select the depth, width, and angle of each of the grooves, and a density of a resilient material in the grooves, if any, to achieve a desired first predetermined flex angle and a desired bending stiffness in both the first range of flex (at flex angles less than the first predetermined flex angle), and the second range of flex at flex angles greater than or equal to the first predetermined flex angle.

Referring to FIG. 2, the grooves 30 extend along their lengths generally transversely in the sole plate 12 on the foot-facing surface 20. Each groove 30 is generally straight, and the grooves 30 are generally parallel with one another. The grooves 30 may be formed, for example, during molding of the sole plate 12.

Alternatively, the grooves 30 may be pressed, cut, or otherwise provided in the sole plate 12. Each groove 30 has a medial end 32 and a lateral end 34 (indicated with reference numbers on only one of the grooves 30 in FIG. 2), with the medial end 32 closer to a medial edge 36 of the sole plate 12, and the lateral end 34 closer to a lateral edge 38 of the sole plate 12. The lateral end 34 is slightly rearward of the medial end 32 so that the grooves 30 fall under and generally follow the anatomy of the metatarsal phalangeal joints of the foot 52. The grooves 30 extend generally transversely in the sole plate 12 from the medial edge 36 to the lateral edge 38.

As best shown in FIG. 2, the sole plate 12 includes a first slot 40 that extends generally longitudinally relative to the sole plate 12 and completely through the sole plate 12 between the medial edge 36 and the grooves 30. The sole plate 12 also has a second slot 42 that extends generally longitudinally relative to the sole plate 12 and completely through the sole plate 12 between the lateral edge 38 and the grooves 30. The first and second slots 40, 42 are curved, bowing toward the medial and lateral edge 36, 38, respectively. The grooves 30 extend from the first slot 40 to the second slot 42. In other words, the medial end 32 of each groove 30 is at the first slot 40, and the lateral end 34 of each groove 30 is at the second slot 42. In other embodiments, two or more sets of grooves can be spaced transversely apart from one another (e.g., with one set on a medial side of the longitudinal midline LM, extending from the first slot 40 and terminating before the longitudinal midline LM, and the other set on a lateral side of the longitudinal midline LM, extending from the second slot 42 and terminating before the longitudinal midline LM). Similarly, three or more sets can be positioned transversely and spaced apart from one another. In such embodiments with multiple sets of transversely spaced grooves, the sole plate may have a recess or aperture between the sets of grooves so that the material of the sole plate does not interfere with closing of the grooves.

Figure 6:
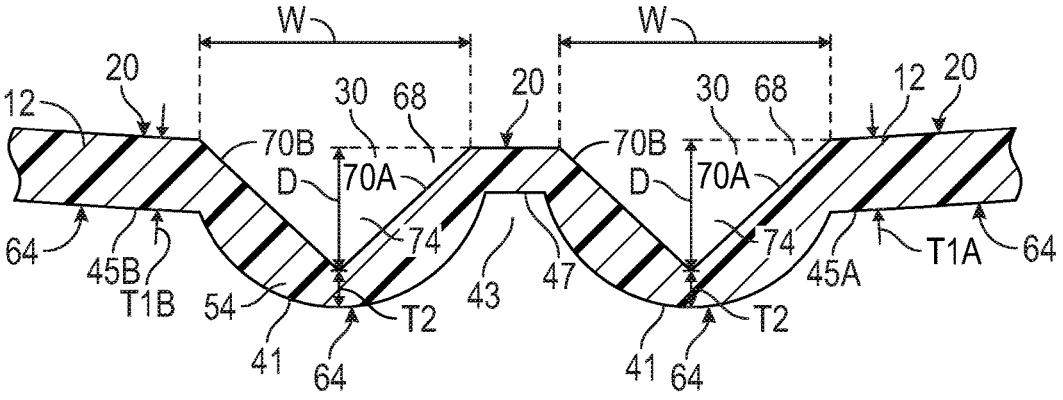
FIG. 6 is a schematic cross-sectional illustration in fragmentary view of the sole structure of FIGS. 1-4 taken at lines 6-6 in FIG. 2.

Unlike the slots 40, 42, the grooves 30 do not extend completely through the sole plate 12, as indicated in FIGS. 6 and 7. The slots 40, 42 help to isolate the series of grooves 30 from the portions of the sole plate 12 outward of the grooves 30 (i.e., the portion between the first slot 40 and the medial edge 36 and the portion between the second slot 42 and the lateral edge 38) during flexing of the sole plate 12.

The sole plate 12 includes a first notch 44 in the medial edge 36 of the sole plate 12, and a second notch 46 in the lateral edge 38 of the sole plate. As best shown in FIG. 2, the first and second notches 44, 46 are generally aligned with the grooves 30 but are not necessarily parallel with the grooves 30. In other words, a line connecting the notches 44, 46 would pass through the grooves 30. The notches 44, 46 increase flexibility of the sole plate 12 in the area of the forefoot portion 14 where the grooves 30 are located. The material of the sole plate 12 outward of the slots 40, 42 thus has little effect on the flexibility of the forefoot portion 14 of the sole plate 12 in the longitudinal direction.

As best shown in FIGS. 3, 4, 6 and 7, the sole plate 12 has a plurality of ribs 41 that protrude at the ground-facing surface 64. The ribs 41 extend generally transversely and underlie the grooves 30. Each of the ribs 41 is coincident with a different respective one of the grooves 30 as each groove 30 is cupped along its length from below by each rib 41. Accordingly, the number of ribs 41 is the same as the number of grooves 30. In the embodiment of FIGS. 1-7, the sole plate 12 has only two ribs 41. The length of the groove 30 extends from the medial end 32 to the lateral end 34. In the embodiment shown, a center line of each groove 30 extending along its length is parallel with and may fall in the same vertical plane as the center axis of the rib 41 below the groove 30.

A flexion channel 43 extends transversely at the ground-facing surface 64 of the sole plate 12 between the adjacent pair of ribs 41. In other words, the ground-facing surface 64 below the grooves 30 is undulated, protruding at the ribs 41 and receding at the flexion channel 43. As shown in FIG. 6, the ribs 41 are generally rounded, and an end surface 47 of the flexion channel 43 on the ground-facing surface 64 is generally flat. The grooves 30 have generally flat walls 70A, 70B that are angled relative to one another such that the grooves 30 are generally V-shaped. The walls 70A, 70B are also referred to herein as side walls, although they extend transversely and are forward and rearward of each groove 30. The intersection of the walls 70A, 70B at the base 54 of each groove 30 is slightly rounded. A portion of the foot-facing surface 20 between the grooves 30 is generally flat. In other embodiments, the grooves 30 could have a more rounded shape, and the ribs 41 could be more angular. Additionally, the end surface 47 could be rounded instead of flat.

With reference to FIGS. 4 and 6, the ribs 41 protrude at the ground-facing surface 64 further than both a portion 45A of the sole plate 12 immediately forward of the ribs 41 and a portion 45B of the sole plate 12 immediately rearward of the ribs 41. Stated differently, the ribs 41 descend from the sole plate 12 further toward the ground G of FIG. 4 when worn on a foot 52 than do the portions 45A, 45B. Additionally, a predetermined depth D of the grooves 30 is greater than a thickness T1A of the portion 45A of the sole plate 12 immediately forward of the grooves 30 and a thickness T1B of the portion 45B of the sole plate 12 immediately rearward of the grooves 30. The ribs 41 are thus configured to allow the grooves 30 to have a greater depth D than the thicknesses T1A, T1B of the surrounding sole plate 12. In the embodiment shown, the thickness T1A and the thickness T1B are equal, but in other embodiments they could be different. The base 54 has a thickness T2 at the deepest part of each groove 30 (i.e., at the depth D), and the thickness T2 is the minimum thickness of the sole plate 12 at the grooves 30.

Figure 24:
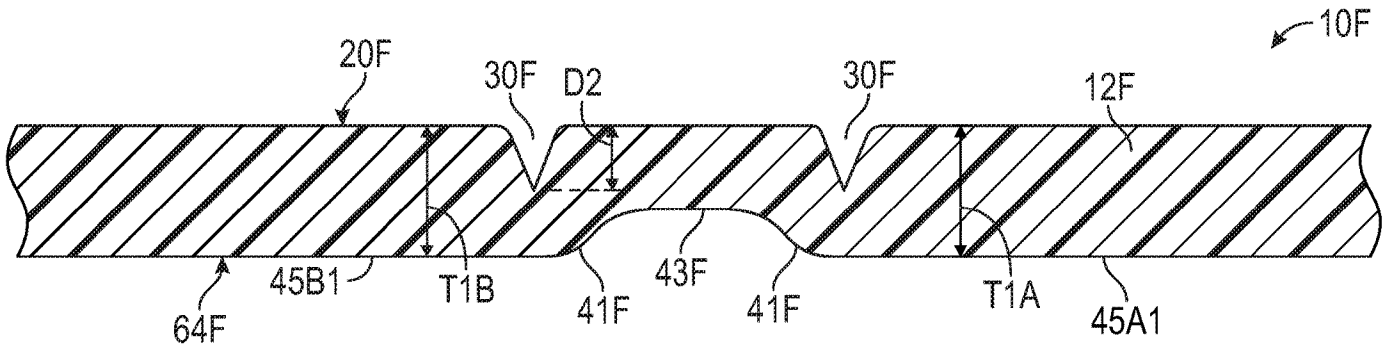
FIG. 24 is a schematic cross-sectional illustration in fragmentary view of an alternative embodiment of a sole structure for an article of footwear in an unflexed position in accordance with the present teachings.

In contrast, FIG. 24 shows an alternative embodiment of a sole structure 10F having a sole plate 12F with ribs 41F that protrude at a ground-facing surface 64F of the sole plate 12F not more than a portion 45A1 of the sole plate 12F immediately forward of the ribs 41F, and not more than a portion 45B1 of the sole plate 12F immediately rearward of the ribs 41F when the sole plate 12F is in an unflexed position as shown. A flexion channel 43F extends transversely at the ground-facing surface 64F of the sole plate 12F between the adjacent pair of ribs 41F. Additionally, a predetermined depth D2 of grooves 30F in a foot-facing surface 20F of the sole plate 12F is not greater than a thickness T1A of the portion 45A1 of the sole plate 12F immediately forward of the grooves 30F and a thickness T1B of the portion 45B1 of the sole plate 12F immediately rearward of the grooves 30F. In the embodiment show, the thickness T1A and the thickness T1B are equal, but in other embodiments they could be different.

Figure 25:
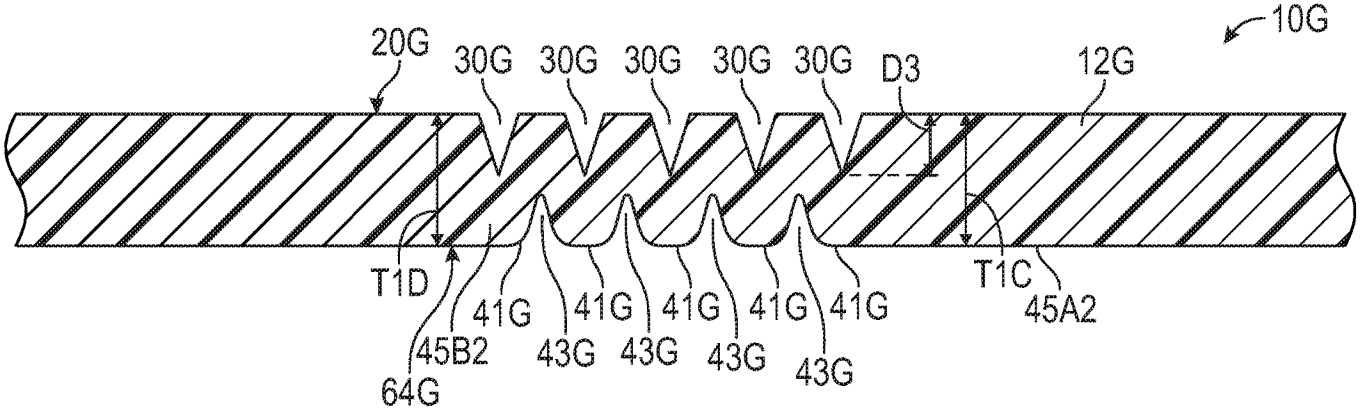
FIG. 25 is a schematic cross-sectional illustration in fragmentary view of an alternative embodiment of a sole structure for an article of footwear in an unflexed position in accordance with the present teachings.

FIG. 25 shows another alternative embodiment of a sole structure 10G having a sole plate 12G with five grooves 30G and with ribs 41G that protrude at a ground-facing surface 64G of the sole plate 12G not more than a portion 45A2 of the sole plate 12G immediately forward of the ribs 41G, and not more than a portion 45B2 of the sole plate 12G immediately rearward of the ribs 41G when the sole plate 12G is in an unflexed position as shown. Flexion channels 43G extend transversely at the ground-facing surface 64G of the sole plate 12G between each adjacent pair of ribs 41G. Additionally, a predetermined depth D3 of grooves 30G in a foot-facing surface 20G of the sole plate 12G is not greater than a thickness T1C of the portion 45A2 of the sole plate 12G immediately forward of the grooves 30G and a thickness T1D of the portion 45B2 of the sole plate 12G immediately rearward of the grooves 30G. In the embodiment show, the thickness T1C and the thickness T1D are equal, but in other embodiments they could be different.

Referring again to the embodiment of FIGS. 1-7, the grooves 30 and the flexion channel 43 promote flexibility of the sole plate 12 in the forefoot portion 14 at flex angles less than the first predetermined flex angle A1. The depth D is one tunable parameter affecting the desired change in bending stiffness, as discussed herein. Referring to FIG. 6, each groove 30 has the predetermined depth D from the surface 20 of the sole plate 12 to a base 54 of the rib 41 below the groove 30. In other embodiments, different ones of the grooves 30 may have different depths, each at least the predetermined depth D.

Figure 5:
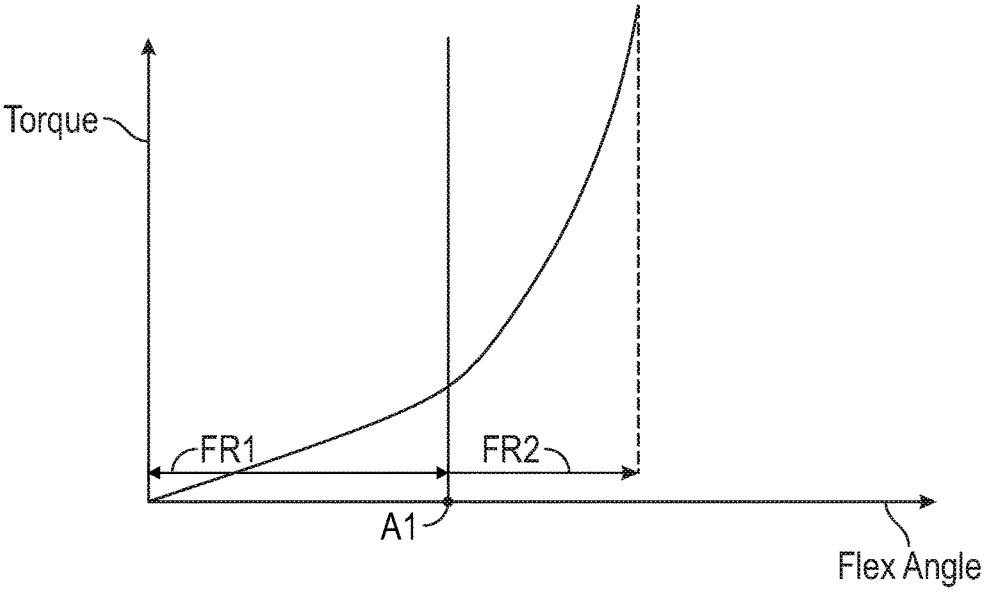
FIG. 5 is a plot of torque versus flex angle for the sole structure of FIGS. 1-4.

Referring to FIGS. 4 and 5, as the foot 52 flexes by lifting the heel portion 18 away from the ground G while maintaining contact with the ground G at a forward portion of the forefoot portion 14, it places torque on the sole structure 10 and causes the sole plate 12 to flex at the forefoot portion 14. The bending stiffness of the sole structure 10 during the first range of flexion FR1 shown in FIG. 5 (i.e., at flex angles less than the first predetermined flex angle A1) will be at least partially correlated with the bending stiffness of the sole plate 12 without compressive forces across the open grooves 30 as open grooves 30 cannot bear such forces.

As will be understood by those skilled in the art, during bending of the sole plate 12 as the foot 52 is flexed, there is a neutral axis of the sole plate 12 above which the sole plate 12 is in compression, and below which the sole plate 12 is in tension. The closing of the grooves 30 places additional compressive forces on the sole plate 12 above the neutral axis, thus effectively shifting the neutral axis of the sole plate 12 downward (toward the ground-facing surface 64) in comparison to a position of the neutral axis when the grooves 30 are open. The lower portion of the sole plate 12, including the bottom surface 64 is under tension, as indicated by tensile forces TF1 in FIG. 7.

FIG. 6 shows the grooves 30 in an open position. The grooves 30 are configured to be open when the sole structure 10 is flexed in the longitudinal direction at flex angles less than the first predetermined flex angle A1 shown in FIG. 4. Stated differently, the grooves 30 are configured to be open during a first range of flexion FR1 indicated in FIG. 5 (i.e., at flex angles less than the first predetermined flex angle A1). For example, in FIGS. 1-3, the sole structure 10 is unflexed (i.e., at a flex angle of 0), and the grooves 30 are open.

The grooves 30 are configured to close when the sole structure 10 is flexed in the longitudinal direction at flex angles greater than or equal to the first predetermined flex angle A1 (i.e., in a second range of flexion FR2 shown in FIG. 5). When the grooves 30 close, the sole plate 12 has a resistance to deformation in response to compressive forces across the closed grooves 30 so that the sole structure 10 has a change in bending stiffness at the first predetermined flex angle A1. FIG. 7 shows the walls 70A, 70B in contact, and the resulting compressive forces CF1 of the sole plate 12 near at least the distal ends 68 (labeled in FIG. 6) of the closed grooves 30. The closed grooves 30 provide resistance to the compressive forces CF1, which may elastically deform the sole plate 12 at the closed grooves 30.

The descending ribs 41 with the flexion channel 43 between the ribs 41 minimizes the resistance at the ground-facing surface 64 to the closing of the grooves 30, and thus minimizes tensile forces TF1 at the base portion 54 resulting from the closing of the grooves 30. For example, the descending ribs 41 allow the depth D of the grooves 30 to be greater as discussed herein, thus increasing the surface area of the walls 70A, 70B. Furthermore, the flexion channel 43 extends upward to the surface 47 which is higher than the base 54 of the rib 41, so that the flexion channel 43 is higher than a lowest extend of the groove 30. Thus, part or all of the ground-facing surface 64 at the flexion channel 43 can also close between the grooves 30 when the sole structure 10 is flexed at least to the first predetermined flex angle A1, further increasing the area over which the compression forces are borne. Stated differently, compressive forces may be borne across the portion of the channel 43 that may close during flexing.

FIG. 5 shows an example plot of torque (in Newton-meters) on the vertical axis and flex angle (in degrees) on the horizontal axis. The torque is applied to the sole plate 12 when the sole structure 10 is dorsiflexed. The plot of FIG. 5 indicates the bending stiffness (slope of the plot) of the sole structure 10 in dorsiflexion. As is understood by those skilled in the art, the torque results from a force applied at a distance from a bending axis located in the proximity of the metatarsal phalangeal joints, as occurs when a wearer dorsiflexes the sole structure 10. The bending stiffness changes (increases) at the first predetermined flex angle A1. The bending stiffness is a piecewise function. In the first range of flexion FR1, the bending stiffness is a function of the bending stiffness of the sole plate 12 without compressive forces across the open grooves 30, as the open grooves 30 cannot bear forces. In the second range of flexion FR2, the bending stiffness is at least in part a function of the compressive stiffness of the sole plate 12 under compressive loading of the sole plate 12 across a distal portion 68 of the closed grooves 30 (i.e., a portion closest to the foot-facing surface 20 and the foot 52).

As an ordinarily skilled artisan will recognize in view of the present disclosure, a sole plate 12 will bend in dorsiflexion in response to forces applied by corresponding bending of a user's foot at the MPJ during physical activity. Throughout the first portion of the flexion range FR1, the bending stiffness (defined as the change in moment as a function of the change in flex angle) will remain approximately the same as bending progresses through increasing angles of flexion. Because bending within the first portion of the flexion range FR1 is primarily governed by inherent material properties of the materials of the sole plate 12, a graph of torque (or moment) on the sole plate 12 versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, the grooves 30 close, such that additional material and mechanical properties exert a notable increase in resistance to further dorsiflexion. Therefore, a corresponding graph of torque versus angle of flexion (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bending stiffness, and would manifest as either or both of a stepwise increase in bending stiffness and/or a change in the rate of increase in the bending stiffness. The change in rate can be either abrupt, or it can manifest over a short range of increase in the bend angle (i.e., also referred to as the flex angle or angle of flexion) of the sole plate 12. In either case, a mathematical function describing a bending stiffness in the second portion of the flexion range FR2 will differ from a mathematical function describing bending stiffness in the first portion of the flexion range.

As will be understood by those skilled in the art, during bending of the sole plate 12 as the foot is dorsiflexed, there is a layer in the sole plate 12 referred to as a neutral plane (although not necessarily planar) or neutral axis above which the sole plate 12 is in compression, and below which the sole plate 12 is in tension. The closing of the grooves 30 places additional compressive forces on the sole plate 12 above the neutral plane, and additional tensile forces below the neutral plane, nearer the ground-facing surface. In addition to the mechanical (e.g., tensile, compression, etc.) properties of the sole plate 12, structural factors that likewise affect changes in bending stiffness during dorsiflexion include but are not limited to the thicknesses, the longitudinal lengths, and the medial-lateral widths of different portions of the sole plate 12.

The sole plate 12 may be entirely of a single, uniform material, or may have different portions comprising different materials. For example, as best shown in FIG. 2, the sole plate 12 includes a first portion 24 and a second portion 26 surrounding a perimeter 28 of the first portion 24. The first portion 24 is mainly in the forefoot portion 14. The grooves 30 and the ribs 41 are in the first portion 24, which is of a first material with a first bending stiffness. The second portion 26 is a second material with a second bending stiffness different than the first bending stiffness. As discussed, the slots 40, 42 and notches 44, 46 help to isolate the grooves 30 from portions of the sole plate 12 laterally outward of the grooves 30 (i.e., the second material). Accordingly, the first material of the first portion 24 can be selected to achieve, in conjunction with the parameters of the grooves 30 and ribs 41, the desired bending stiffness in the forefoot portion 14, while the second material of the second portion 26 can be selected as a less stiff material that has little effect on the bending stiffness of the forefoot portion 14 at the grooves 30. By way of non-limiting example, the second portion 26 can be over-molded on or co-injection molded with the first portion 24.

Generally, the width and depth of the grooves in any of the embodiments described herein will depend upon the number of grooves that extend generally transversely in the forefoot region, and will be selected so that the grooves close at the first predetermined flex angle described herein. In various embodiments, different ones of the grooves could have different depths, widths, and or spacing from one another, and could have different angles (i.e., adjacent walls of the sole plate 12 at different grooves could be at different relative angles). For example, grooves toward the middle of a series of grooves in the longitudinal direction could be wider than grooves toward the anterior and posterior ends of the series of grooves. Generally, the overall width of the plurality of grooves (i.e., from the anterior end to the posterior end of the plurality of grooves) is selected to be sufficient to accommodate a range of positions of a wearer's metatarsal phalangeal joints based on population averages for the particular size of footwear. If only two grooves 30 are provided, they will each generally have a greater width and have a greater angle between adjacent walls than an embodiment with more than two grooves, assuming the same depth of the grooves in both embodiments, in order for the grooves to close when the sole plate is at the same predetermined first flex angle, as illustrated by the greater widths W of the grooves 30 of FIG. 6 than the widths W1 of the grooves 30C of FIG. 15.

Referring to FIG. 6, each groove 30 has a predetermined width W at the foot-facing surface 20. Although not shown in the embodiment of FIG. 6, the surface 20 may be chamfered or rounded at each groove 30 to reduce the possibility of plastic deformation as could occur with sharp corner contact when compressive forces are applied across the closed grooves 30. If chamfered or rounded in this manner, then the width W would be measured between adjacent walls 70A, 70B of the sole plate 12 at the start of any chamfer (i.e., at the point on the side wall 70A or 70B just below any chamfered or rounded edge).

Each of the grooves 30 is narrower at a base 74 of the groove 30 (also referred to as a root of the groove 30, just above the base portion 54 of the sole plate 12) than at the distal portion 68 (which is at the widest portion of the groove 30 closest to the foot-facing surface 20 at the grooves 30) when the grooves 30 are open. Although each groove 30 is depicted as having the same width W, different ones of the grooves 30 could have different widths.

Optionally, the predetermined depth D and predetermined width W can be tuned (i.e., selected) so that adjacent walls (i.e. a front side wall 70A and a rear side wall 70B at each groove 30) are nonparallel when the grooves 30 are open, as shown in FIG. 6. The adjacent walls 70A, 70B are parallel when the grooves 30 are closed (or at least closer to parallel than when the grooves 30 are open), as shown in FIG. 7. By configuring the sole plate 12 so that the walls 70A, 70B are nonparallel in the open position, surface area contact of the walls 70A, 70B is maximized when the grooves 30 are closed, such as when walls 70A, 70B are parallel when closed. In such an embodiment, the entire planar portions of the walls 70A, 70B can simultaneously come into contact when the grooves 30 close.

Optionally, the grooves 30 can be configured so that forward walls 70A at each of the grooves 30 incline forward at each of the grooves 30 (i.e., in a forward direction toward a forward extent of the forefoot portion 14, which is toward the front of the sole plate 12 in the longitudinal direction) at each of the grooves 30 and the rearward walls 70B incline in a rearward direction (i.e., toward the heel portion 18) when the grooves 30 are open and the sole plate 12 is in an unflexed position. The unflexed position shown in FIG. 1 is the position of the sole plate 12 when the heel portion 18 is not lifted and traction elements 69 at both the forefoot portion 14 and the heel portion 18 are in contact with the ground G of FIG. 4. In the unflexed, relaxed state of the sole plate 12, the sole plate 12 may have a flex angle of zero degrees. The relative inclinations of the walls 70A, 70B affect when the grooves 30 close (i.e., at which flex angle the grooves 30 close) flexion FR. The greater forward inclination of the front walls 70A and the greater rearward inclination of the rear walls 70B ensure that the grooves 30 close at a greater first predetermined flex angle A1 than if the rearward walls 70B inclined forward more than the forward walls 70A. In still other embodiments, the grooves can be configured so that only portions of the adjacent sidewalls at each groove contact one another when the grooves close.

As best shown in FIG. 1, the sole plate 12 has traction elements 69 that protrude further from the ground-facing surface 64 than the base portion 54 of the sole plate 12 at the grooves 30 (as is evident in FIGS. 3 and 4), thus ensuring that the ribs 41 are either removed from ground-contact (i.e., lifted above the ground G) or at least bear less load. Ground reaction forces on the ribs 41 that could lessen flexibility of the base portion 54 and affect opening and closing of the grooves 30 are thus prevented or reduced. The traction elements 69 may be integrally formed as part of the sole plate 12 or may be attached to the sole plate 12. In the embodiment shown, the traction elements 69 are integrally formed cleats. For example, as best shown in FIG. 1, the sole plate 12 has dimples 73 on the foot-facing surface 20 where the traction elements 69 extend downward. In other embodiments, the traction elements may be, for example, removable spikes attached at the ground-facing surface 64.

Figure 8:
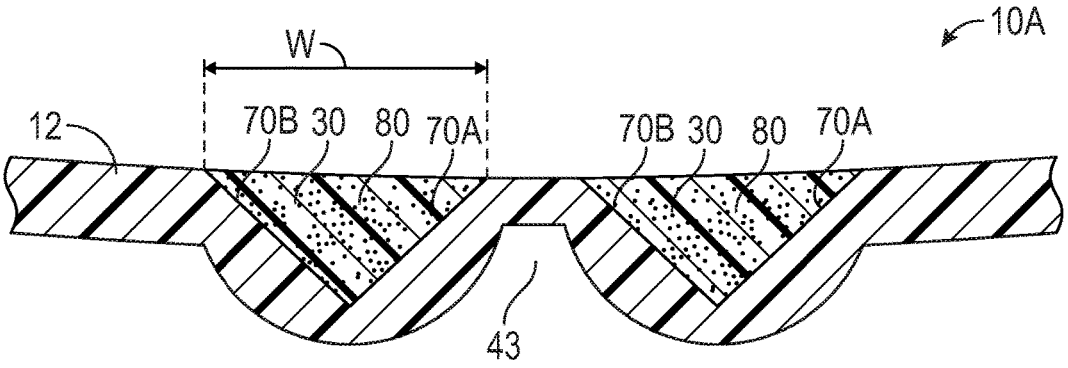
FIG. 8 is a schematic cross-sectional illustration in fragmentary view of an alternative embodiment of a sole structure for an article of footwear in an unflexed position in accordance with the present teachings.
Figure 9:
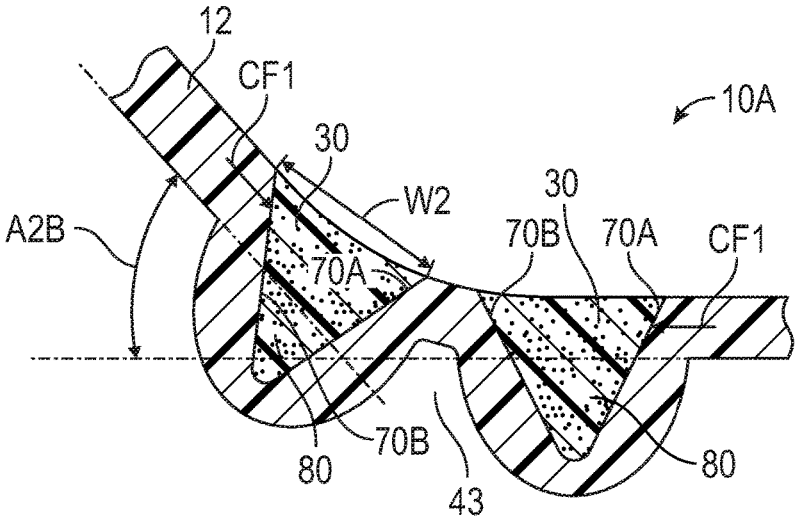
FIG. 9 is a schematic cross-sectional illustration in fragmentary view of the sole structure of FIG. 8 flexed at a first predetermined flex angle.

FIGS. 8 and 9 show a portion of an embodiment of a sole structure 10A in which a resilient material 80 is disposed in the grooves 30 of the sole plate 12. In the embodiment shown, for purposes of illustration, the resilient material 80 is disposed in each of the grooves 30 of the sole plate 12. Optionally, the resilient material 80 can be disposed in only one of the grooves 30. The resilient material 80 may be a resilient (i.e., reversibly compressible) polymeric foam, such as an ethylene vinyl acetate (EVA) foam or a thermoplastic polyurethane (TPU) foam or rubber selected with a compression strength and hardness that provides a compressive stiffness different than (i.e., less than or greater than) the compressive stiffness of the materials of the sole plate 12. For example, a foam or rubber material, such as but not limited to a foam or rubber with a Shore A Durometer hardness of about 50-70 (using ASTM D2240-05(2010)

standard test method) or an Asker C hardness of 65-85 (using hardness test JIS K6767 (1976) may be used for the resilient material.

In FIG. 8, the sole structure 10A is shown in a relaxed, unflexed state having a flex angle of 0 degrees. The grooves 30 are in the open position in FIG. 8, although they are filled with the resilient material 80. In the embodiment shown, the sole plate 12 is configured to have a greater compressive stiffness (i.e., resistance to deformation in response to compressive forces) than the resilient material 80. Accordingly, when the flex angle increases during dorsiflexion, the resilient material 80 will begin being compressed by the sole plate 12 at the closing grooves during bending of the sole structure 10A as the sole plate 12 flexes (i.e., bends) until the resilient material 80 reaches a maximum compressed position for the given compressive force at a first predetermined flex angle A2B shown in FIG. 9. At the maximum compressed position of the resilient material 80 of FIG. 9, the grooves 30 are in a closed position as the adjacent walls 70A, 70B of each groove cannot move any closer together. The resilient material 80 therefore increases the bending stiffness of the sole structure 10A at flex angles less than a flex angle at which the grooves 30 reach the closed position (i.e., the first predetermined flex angle A2B) in comparison to embodiments in which the grooves 30 are empty as more torque is required to flex the sole plate 12 with the resilient material 80 in the grooves 30. The bending stiffness of the sole structure 10A is therefore at least partially determined by a compressive stiffness of the resilient material 80 at flex angles less than the first predetermined flex angle A2B.

When the grooves 30 of the sole structure 10A are closed, adjacent walls 70A, 70B of the sole plate 12 at each groove 30 do not contact one another and are not parallel, but are closer together than when the grooves 30 are open. In other words, the closed grooves 30 of an embodiment with resilient material 80 in the grooves 30 have a width W2 less than the width W of the open grooves 30. Because the resilient material 80 prevents the walls 70A, 70B from contacting one another, the first predetermined flex angle A2B is less than the first predetermined flex angle would be if the grooves were empty, and assuming that the ribs 41 do not contact one another at the ground-facing surface 64 (as they do in FIG. 7). Resilient material 80 can be similarly disposed in any or all of the grooves of any of the alternative sole structures 10, 10C, 10D, 10E disclosed herein.

Figure 10:
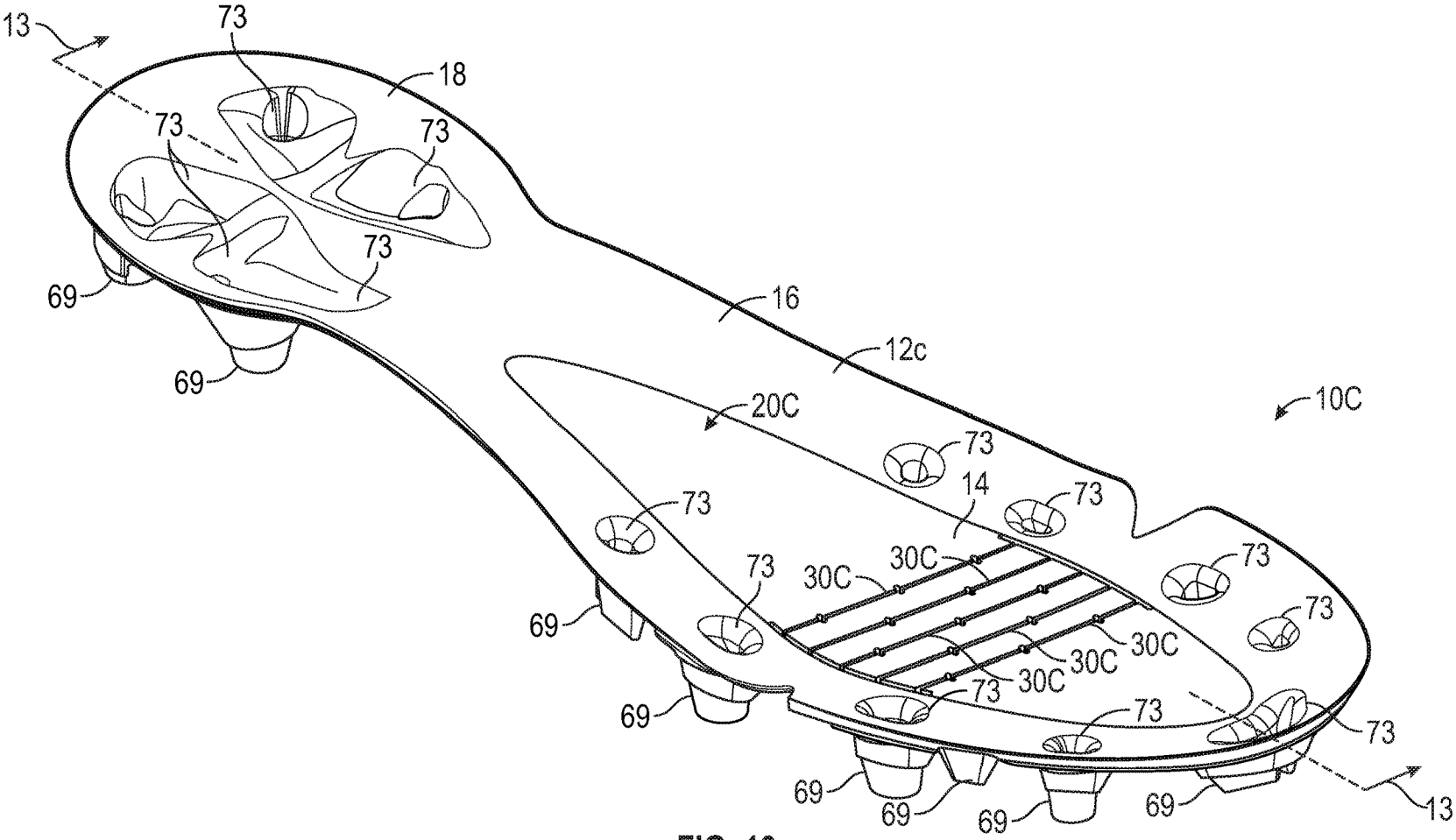
FIG. 10 is a schematic illustration in perspective view of an alternative embodiment of a sole structure for an article of footwear in an unflexed position in accordance with the present teachings.
Figure 11:
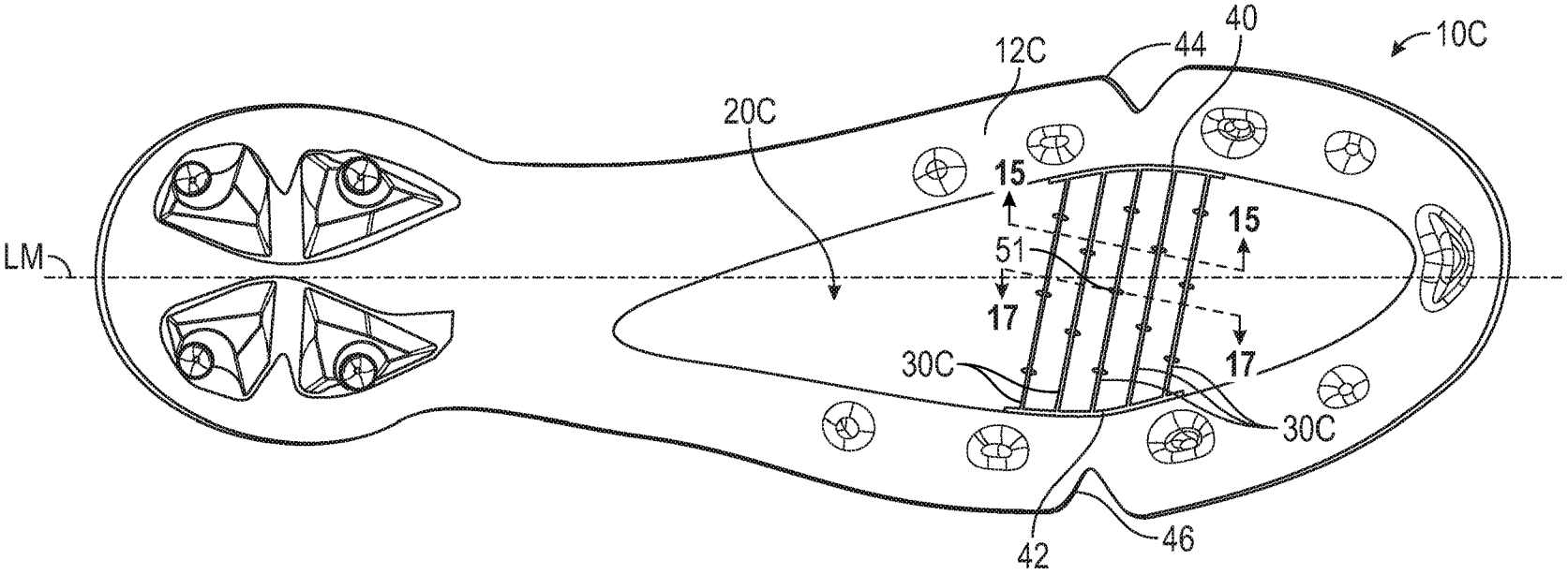
FIG. 11 is a schematic illustration in plan view of the sole structure of FIG. 10.
Figure 12:
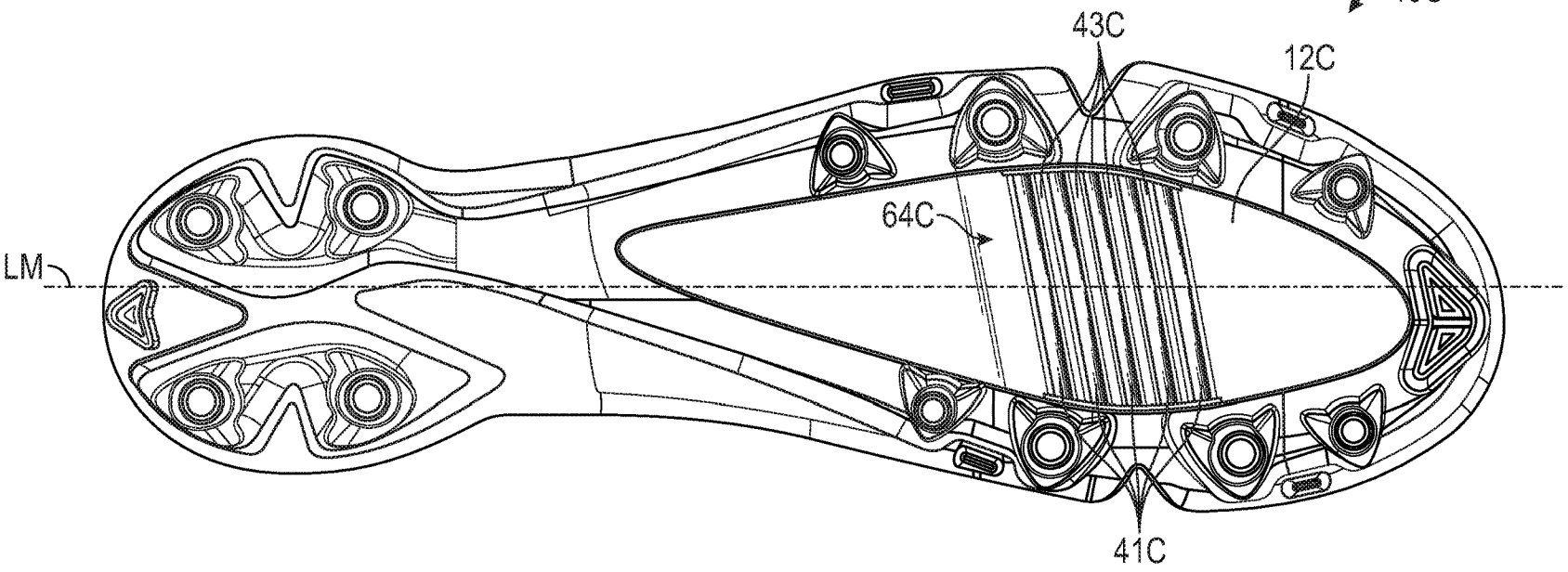
FIG. 12 is a schematic illustration in bottom view of the sole structure of FIG. 10.
Figure 13:
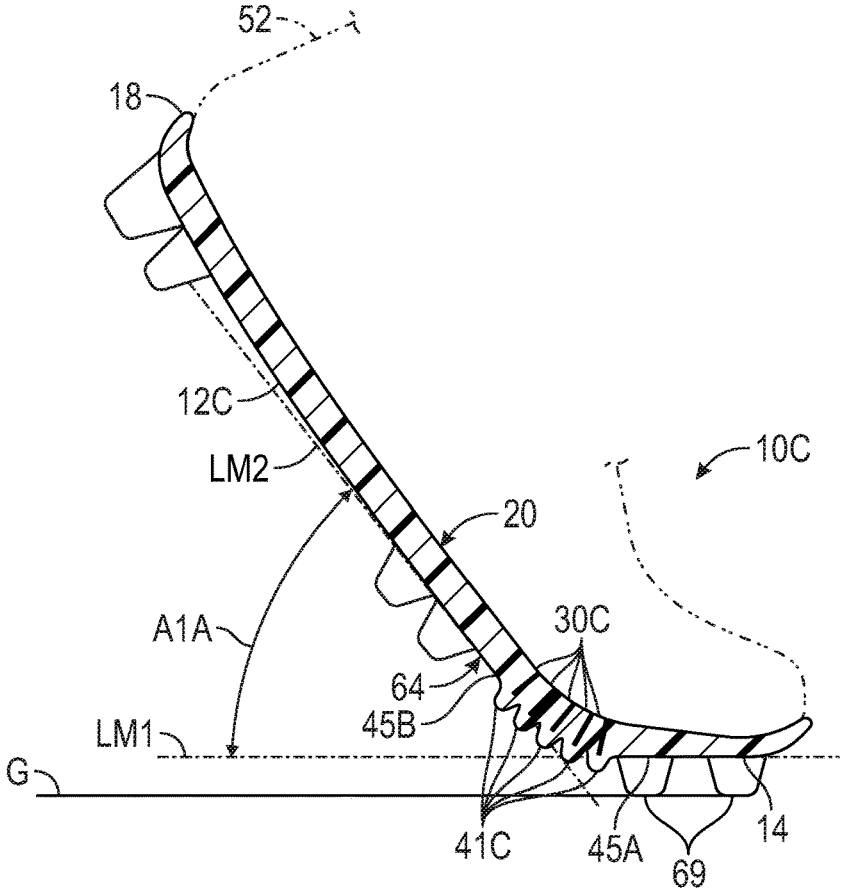
FIG. 13 is a schematic cross-sectional side view illustration of the sole structure of FIG. 10 taken at lines 13-13 in FIG. 10 and flexed at a first predetermined flex angle.
Figure 14:
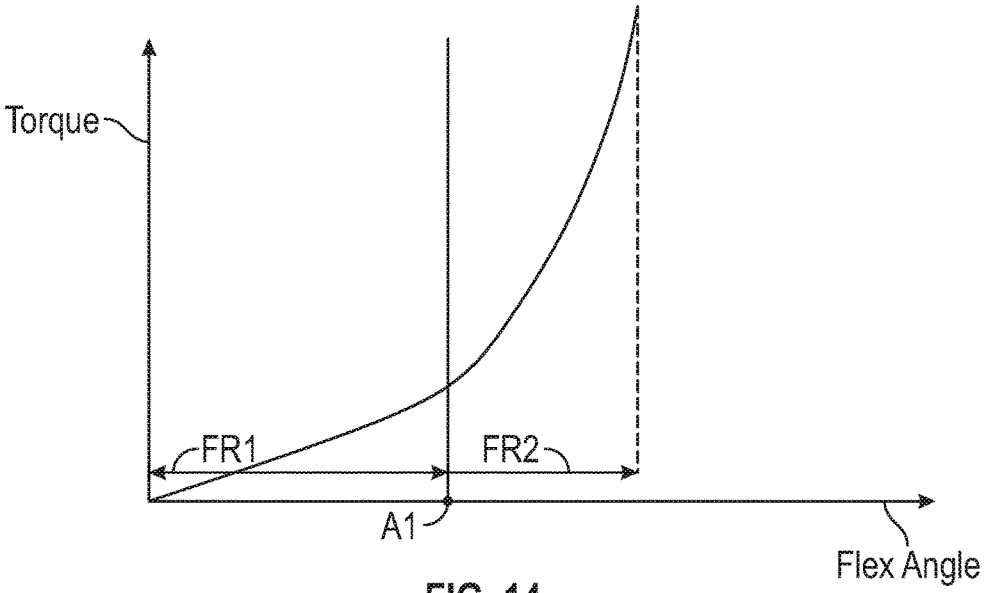
FIG. 14 is a plot of torque versus flex angle for the sole structure of FIGS. 10-13.

FIGS. 10-12 show another embodiment of a sole structure 10C for an article of footwear that flexes at a first predetermined flex angle A1A shown in FIG. 13 to provide a change in bending stiffness as shown in FIG. 14. The flex angle A1A may be the same or different than the flex angle A1 of FIG. 5. The sole structure 10C has many of the same features that are configured and function as described with respect to the sole structure 10, and such are numbered with like reference numbers.

Figure 15:
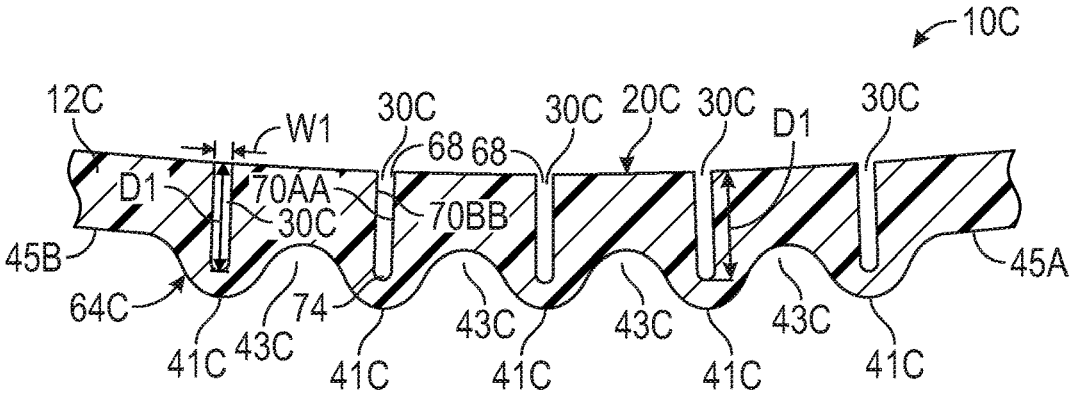
FIG. 15 is a schematic cross-sectional illustration in fragmentary view of the sole structure of FIGS. 10-13 taken at lines 15-15 in FIG. 11.

The sole structure 10C includes a sole plate 12C configured the same as the sole plate 12 except that grooves 30C, ribs 41C, and flexion channels 43C are used in place of grooves 30, ribs 41, and flexion channel 43. There are five grooves 30C, five underlying ribs 41C, each coincident and underlying a respective one of the grooves 30C, and four flexion channels 43C, each extending transversely at a ground-facing surface 64C between a different respective pair of adjacent ribs 41C. The differently configured grooves 30C and ribs 41C thus provide a slightly different foot-facing surface 20C and ground-facing surface 64C than foot-facing surface 20 and ground-facing surface 64. As shown in FIG. 15, the ribs 41C protrude at the ground-facing surface 64C further than both the portion 45A of the sole plate 12C forward of the grooves 30C and the portion 45B of the sole plate 12C rearward of the grooves 30C.

Referring to FIGS. 13 and 14, as the foot 52 flexes by lifting the heel portion 18 away from the ground G while maintaining contact with the ground G at a forward portion of the forefoot portion 14, it places torque on the sole structure 10C and causes the sole plate 12C to flex at the forefoot portion 14. The bending stiffness of the sole structure 10C during the first range of flexion FR1 shown in FIG. 14 (i.e., at flex angles less than the first predetermined flex angle A1A) will be at least partially correlated with the bending stiffness of the sole plate 12C, but without compressive forces across the open grooves 30C as open grooves 30C cannot bear such forces.

FIG. 14 shows an example plot of torque (in Newton-meters) on the vertical axis and flex angle (in degrees) on the horizontal axis when the sole structure 10C is dorsiflexed. The plot of FIG. 14 indicates the bending stiffness (slope of plot) of the sole structure 10C in dorsiflexion. As is understood by those skilled in the art, the torque results from a force applied at a distance from a bending axis located in the proximity of the metatarsal phalangeal joints, as occurs when a wearer dorsiflexes the sole structure 10C. The bending stiffness of the sole structure 10C is nonlinear and changes (increases) at the first predetermined flex angle A1A. The bending stiffness is a piecewise function. In the first range of flexion FR1, the bending stiffness is a function of the bending stiffness of the sole plate 12C without compressive forces across the open grooves 30C, as the open grooves 30C cannot bear forces. In the second range of flex FR2, the bending stiffness is at least in part a function of the compressive stiffness of the sole plate 12C under compressive loading of the sole plate 12C across a distal portion 68 of the closed grooves 30C (i.e., a portion closest to the foot-facing surface 20 and the foot 52).

As shown, due to the greater number of grooves 30C, the width W1 of each groove 30C is less than the width W of grooves 30 so that the predetermined flex angle A1A will be the same or close to the same numerical value as the predetermined flex angle A1, if desired. The width W1 is much less than the width of the flexion channels 43C between each pair of grooves 30C as is evident in FIG. 15. Accordingly, the flexion channels 43C are less likely to close at the outer surface 64C when the grooves 30C close than are the flexion channels 43 of FIGS. 6 and 7, and compression forces are thus not borne across adjacent ribs 41C because the flexion channel 43C between adjacent ribs 41C will remain open.

Figure 16:
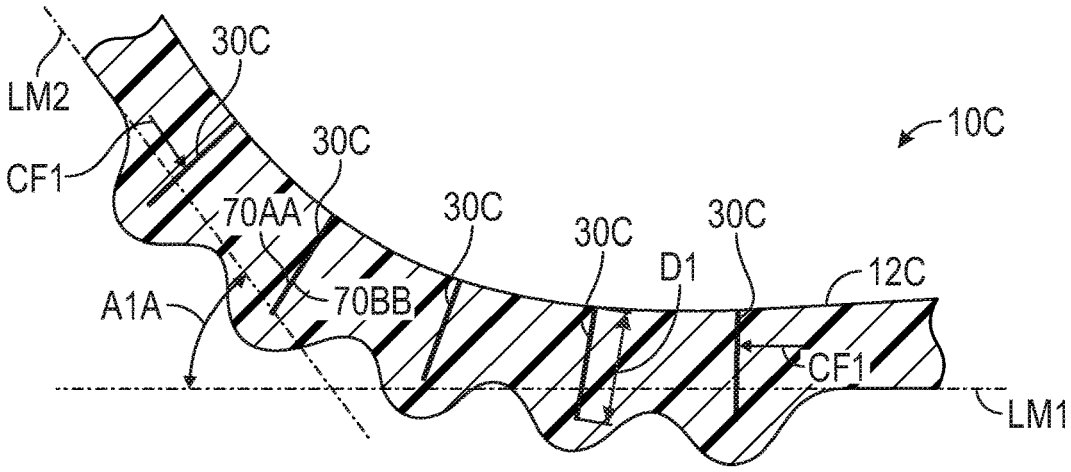
FIG. 16 is a schematic cross-sectional illustration in fragmentary view of the sole structure of FIG. 15 flexed at the first predetermined flex angle.

FIG. 16 depicts each of the grooves 30C closed along the entire depth D1 of the groove 30C. The depth D1 can be the same or different than the depth D of the grooves 30. The adjacent walls 70AA and 70BB of the grooves 30C (i.e., front side wall 70AA and rear side wall 70BB) are substantially parallel when the sole plate 12C is in the unflexed position of FIG. 15 (i.e., at a flex angle of 0 degrees along the longitudinal midline LM of FIG. 11). Accordingly, when the walls 70AA, 70BB close together, the base portion 74 (see FIG. 15) of each groove 30C may remain open, or may also close depending upon the magnitude of the compressibility and stiffness of the material of the sole plate 12C. The sole plate 12C has a resistance to deformation in response to compressive forces CF1 applied across the closed grooves 30C.

Figure 17:
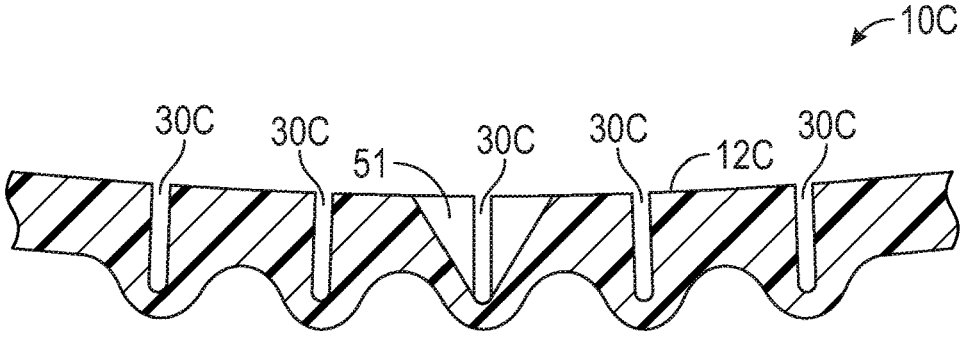
FIG. 17 is a schematic cross-sectional illustration in fragmentary view of the sole structure of FIGS. 10-16 taken at lines 17-17 in FIG. 11.

FIG. 17 shows a recess 51 that interrupts one of the grooves 30C along its length at the location of the cross-section. FIG. 11 shows a plurality of such recesses 51 staggered along adjacent grooves 30C. The sole plate 12C is injection molded, and the recesses 51 result from a mold tool positioned to hold mold inserts around which the grooves 30C are formed. The recesses 51 are thus a result of manufacturing and are not a feature that affects the bending stiffness of the sole structure 12C especially given the very short length and small volume of the recesses 51 in comparison to the length and volume of the grooves 30C, as is apparent in FIG. 11.

Figure 18:
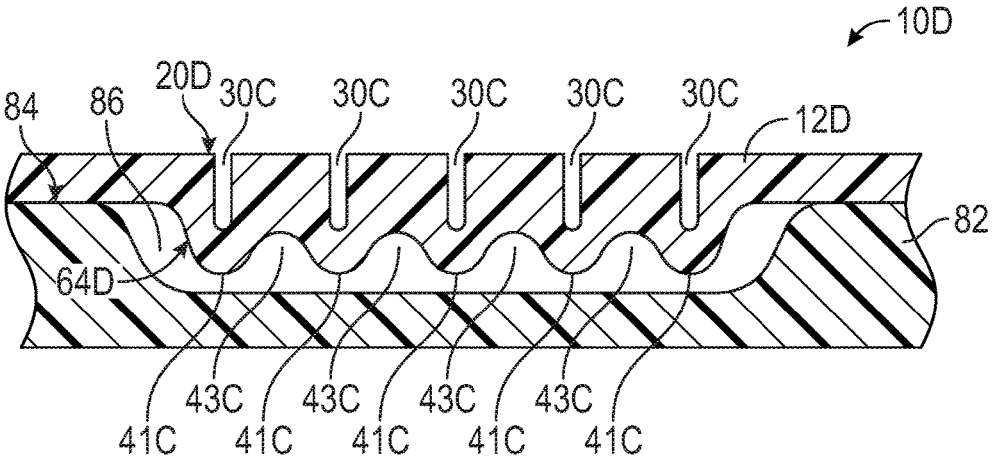
FIG. 18 is a schematic cross-sectional illustration in fragmentary view of an alternative embodiment of a sole structure for an article of footwear in an unflexed position in accordance with the present teachings.
Figure 19:
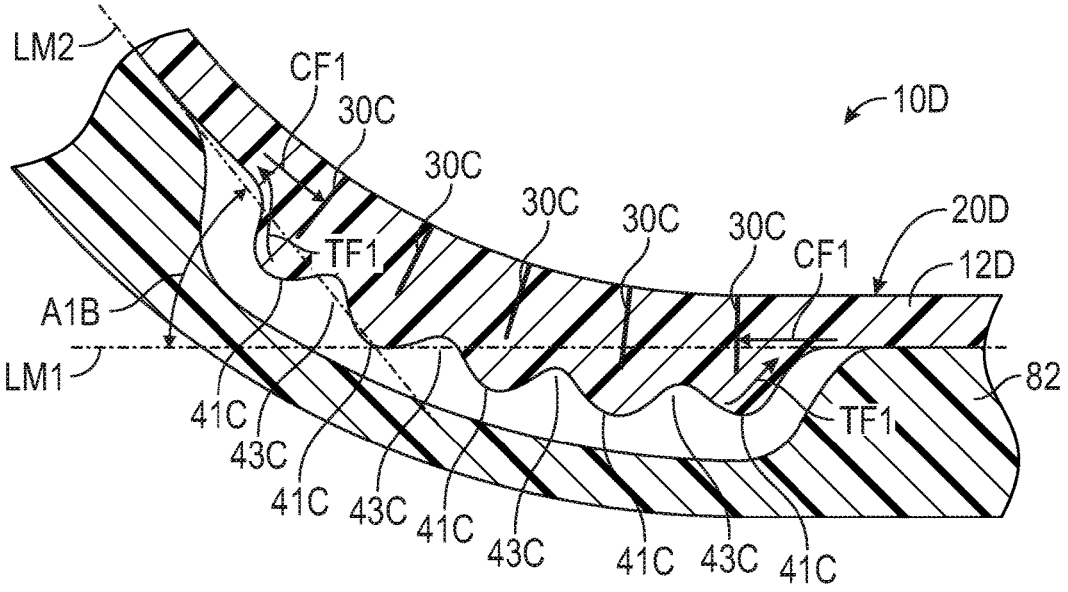
FIG. 19 is a schematic cross-sectional illustration in fragmentary view of the sole structure of FIG. 18 flexed at a first predetermined flex angle.

FIGS. 18-19 show another embodiment of a sole structure 10D for an article of footwear that dorsiflexes at a first predetermined flex angle A1B as shown in FIG. 19 to provide a nonlinear change in bending stiffness of the sole structure 10D similar to that of sole structure 10C at angle A1A in FIG. 14. The flex angle A1B may have a numerical value that is the same or different than the flex angle A1 of FIG. 5 or the flex angle A1A of FIG. 14. The sole structure 10D includes a first sole plate 12D with grooves 30C, descending ribs 41C and flexion channels 43C that can be identical to those of the sole plate 12C. However, the sole plate 12D is an insole board plate or a midsole plate, an insole, a midsole, or a combination of an insole and a midsole rather than an outsole plate. Accordingly, the foot-facing surface 20D of the sole plate 12D does not have dimples 73 and a ground-facing surface 64D of the sole plate 12D at which the ribs 41C protrude does not include the traction elements 69. Instead, the sole structure 10D includes a second sole plate 82, which can be an outsole plate 82 that includes any desired traction elements or to which such are attached. The outsole plate 82 underlies the ground-facing surface 64D of the sole plate 12D, and has a surface 84 with a recess 86 facing the ground-facing surface 64D of the sole plate 12D. The ribs 41C of the first sole plate 12D extend into the recess 86. The grooves 30C are thus free to close when flexed to the first predetermined flex angle A1B without interference from the outsole plate 82. In addition to the bending stiffness of the sole plate 12D, the bending stiffness of the outsole plate 82 also contributes to the overall bending stiffness of the sole structure 10D, but the closing of the grooves 30C at the first predetermined flex angle A1B causes a nonlinear change in the overall bending stiffness of the sole structure 10D.

Figure 20:
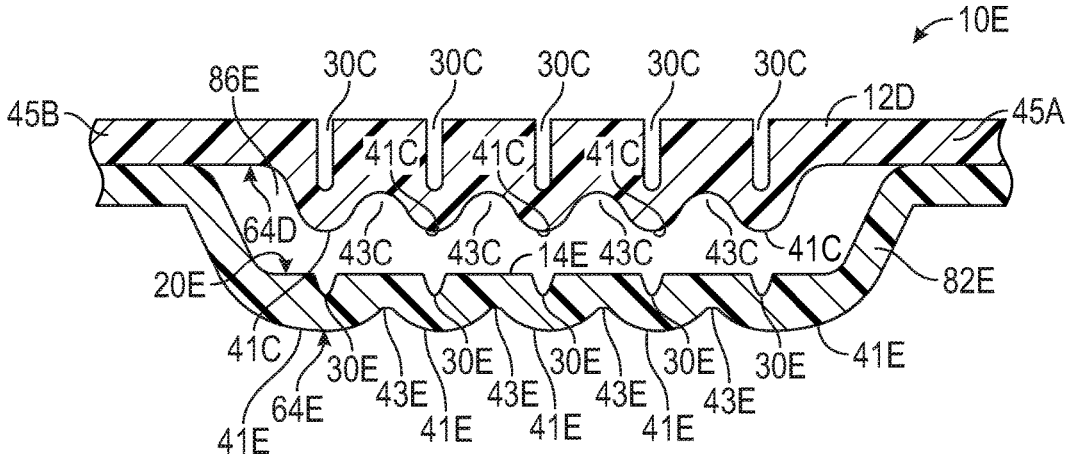
FIG. 20 is a schematic cross-sectional illustration in fragmentary view of an alternative embodiment of a sole structure for an article of footwear in an unflexed position in accordance with the present teachings.
Figure 21:
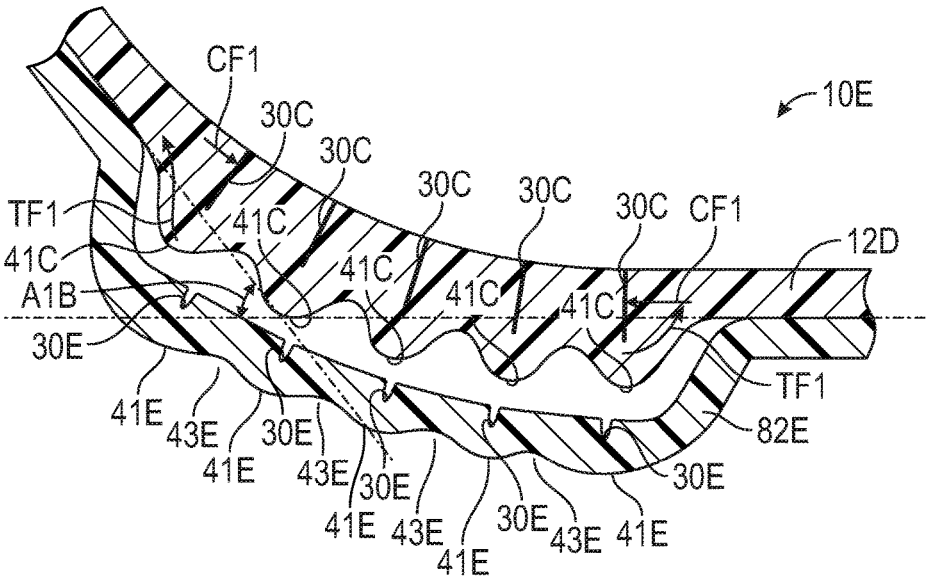
FIG. 21 is a schematic cross-sectional illustration in fragmentary view of the sole structure of FIG. 20 flexed at a first predetermined flex angle.
Figure 22:
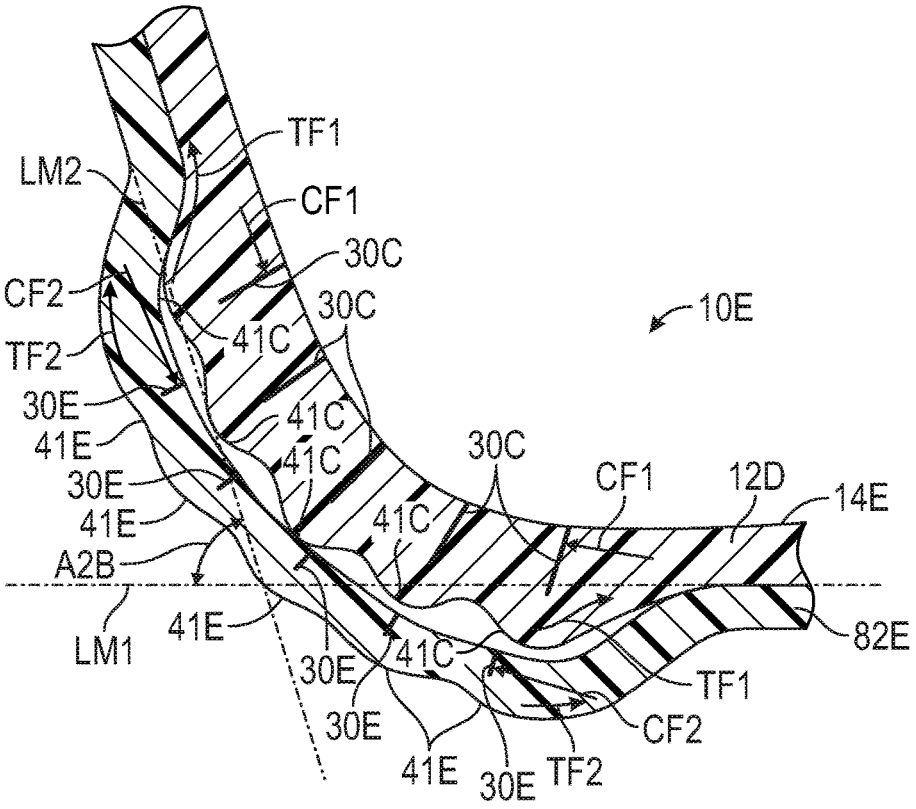
FIG. 22 is a schematic cross-sectional illustration in fragmentary view of the sole structure of FIG. 20 flexed at a second predetermined flex angle.

FIGS. 20-22 show another embodiment of a sole structure 10E for an article of footwear that dorsiflexes at both a first predetermined flex angle A1B shown in FIG. 21 to provide a first nonlinear change in bending stiffness, and at a second predetermined flex angle A2B shown in FIG. 22 to provide a second nonlinear change in bending stiffness. The sole structure 10E includes the first sole plate 12D (i.e., the insole board plate) having the first plurality of grooves 30C and the first plurality of ribs 41C as described with respect to FIGS. 18-19. A second sole plate 82E is an outsole 82E and is included in the sole structure 10E. The outsole plate 82E has a recess 86E facing the ground-facing surface 64D of the sole plate 12D. The ribs 41C of the first sole plate 12D extend into the recess 86E.

The second sole plate 82E underlies the ground-facing surface 64D of the first sole plate 12D. The second sole plate 82E includes a foot-facing surface 20E with a forefoot portion 14E and includes a second plurality of grooves 30E extending generally transversely in the forefoot portion 14E of the foot-facing surface 20E. The second sole plate 82E also has a ground-facing surface 64E opposite the foot-facing surface 20E. A second plurality of ribs 41E protrude at the ground-facing surface 64E and extend generally transversely, underlying the second plurality of grooves 30E. A respective flexion channel 43E is provided at the ground-facing surface 64E between each adjacent pair of ribs 41E.

The grooves 30E are configured to be open when the forefoot portion 14E of the sole structure 10E is dorsiflexed in a longitudinal direction of the sole structure 10E at flex angles less than a second predetermined flex angle A2B, and closed when the sole structure 10E is dorsiflexed in the longitudinal direction at flex angles greater than or equal to the second predetermined flex angle A2B, as shown in FIG. 22. The width, depth, and spacing of the grooves 30E are selected so that the grooves 30E do not close until the flex angle is greater than or equal to the flex angle A2B. Accordingly, the grooves 30E are still open at the first predetermined flex angle A1B when the grooves 30C close, as shown in FIG. 21. The second sole plate 82E has a resistance to deformation in response to compressive forces applied across the grooves 30E. The sole structure 10E thereby has a second nonlinear change in bending stiffness at the second predetermined flex angle A2B.

Figure 23:
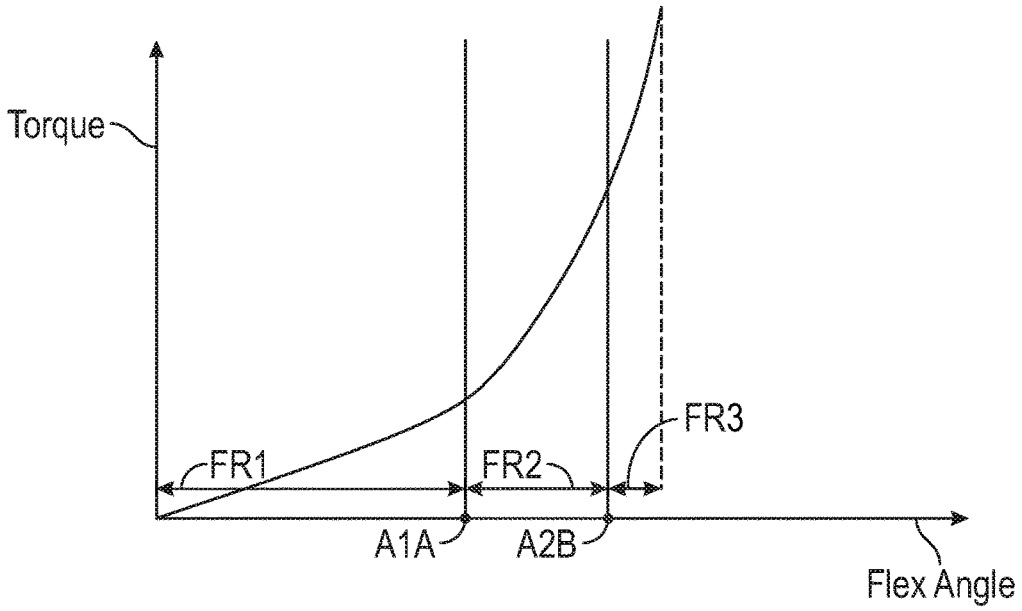
FIG. 23 is a plot of torque versus flex angle for the sole structure of FIGS. 20-22.

As a foot dorsiflexes by lifting the heel portion away from the ground while maintaining contact with the ground at a forward portion of the forefoot portion of the sole plate 12D, it places torque on the sole structure 10E and causes the sole plate 12D to dorsiflex at the forefoot portion 14E. The bending stiffness of the sole structure 10E during the first range of flexion FR1 shown in FIG. 23 (i.e., at flex angles less than the first predetermined flex angle A1A) will be at least partially correlated with the bending stiffness of the sole plate 12D, but without compressive forces across the open grooves 30C and 30E as open grooves 30C and 30E cannot bear such forces. In the second range of flexion FR2, the bending stiffness is at least in part a function of the compressive stiffness of the sole plate 12D under compressive loading of the sole plate 12D across the closed grooves 30C. In a third range of flexion FR3 (i.e., at flex angles greater than or equal to the second predetermined flex angle A2B), the bending stiffness is at least in part a function of the compressive stiffness of the sole plate 82E under compressive loading of the sole plate 82E across the closed grooves 30E, represented by compressive forces CF2 in FIG. 22. A lower portion of the sole plate 12D is subject to tensile forces TF1 during the flexing, and a lower portion of the sole plate 82E is subject to tensile forces TF2 during the flexing. The sole plate 12D may be the same or a different material than the sole plate 82E. Still further, the sole plate 12D may have a first portion (including the grooves 30C and ribs 41C) of a first material, and a second portion surrounding a perimeter of the first portion and of a second material, as discussed with respect to sole plate 12. Accordingly, due at least to the differently configured grooves 30C, 30E, different thicknesses of the sole plates 12D, 82E, and potentially different materials, a bending stiffness of the first sole plate 12D may be different than a bending stiffness of the second sole plate 82E.

Various materials can be used for any of the sole plates 12, 12C, 12D, 82, 82E discussed herein. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05(2010) standard test method) or an Asker C hardness of 65-85 (using hardness test JIS K6767 (1976)) may be used for the respective sole plate 12, 12C, 12D, 82, 82E. If the sole plate 12, 12C, 12D, 82, 82E has different portions with different materials, as discussed with respect to the sole plate 12 of FIG. 1, the first portion 24 may be a stiffer material than the second portion 26. For example, the first portion 24 may be a stiffer TPU than the second portion 26, or may be a nylon while the second portion is a relatively flexible TPU, etc.

The sole structures 10, 10A, 10C, 10D and 10E may also be referred to as sole assemblies, especially when the corresponding sole plates 12, 12C, 12D, 82, 82E are assembled with other sole components in the sole structures, such as with other sole layers.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:
a sole plate that has a foot-facing surface with a forefoot portion, and a ground-facing surface opposite from the foot-facing surface;
wherein the sole plate has:
a plurality of grooves extending at least partially transversely relative to the sole plate in the forefoot portion of the foot-facing surface; and
a plurality of ribs protruding at the ground-facing surface, extending at least partially transversely relative to the sole plate, and underlying the plurality of grooves;
wherein:
the plurality of ribs protrudes at the ground-facing surface further than both a first portion of the sole plate immediately forward of the plurality of ribs and the plurality of grooves and a second portion of the sole plate immediately rearward of the plurality of ribs and the plurality of grooves;
the first portion and the second portion are free of ribs at the ground-facing surface and free of grooves at the foot-facing surface;
the grooves are spaced apart from one another by less than a width of each of the grooves; and
at least some grooves of the plurality of grooves are configured to be open when the sole structure is in an unflexed position and closed when the sole structure is dorsiflexed.

2. The sole structure of claim 1, wherein:
the at least some of the grooves close when the sole structure is dorsiflexed at an angle between a first axis extending along a longitudinal midline of the sole plate at the ground-facing surface anterior to the plurality of grooves and a second axis extending along the longitudinal midline posterior to the plurality of grooves; and
the sole structure has a change in bending stiffness when the at least some of the grooves close.

3. The sole structure of claim 2, wherein the at least some of the grooves close when the angle is an angle selected from the range of angles extending from 35 degrees to 65 degrees.

4. The sole structure of claim 1, wherein the sole plate has a resistance to deformation in response to compressive forces applied across the plurality of grooves when the plurality of grooves is closed.

5. The sole structure of claim 1, wherein each rib of the plurality of ribs is coincident with a different respective groove of the plurality of grooves.

6. The sole structure of claim 1, wherein:
each groove of the plurality of grooves extends further downward than both the ground-facing surface of the first portion of sole plate immediately forward of the plurality of ribs and further downward than the ground-facing surface of the second portion of sole plate immediately rearward of the plurality of ribs.

7. The sole structure of claim 1, wherein:
the sole plate has at least one flexion channel extending at least partially transversely relative to the sole plate at the ground-facing surface of the sole plate; and
the at least one flexion channel is between an adjacent pair of ribs of the plurality of ribs.

8. The sole structure of claim 1, wherein adjacent walls of the sole plate at each groove of the plurality of grooves include:
a front wall inclining in a forward direction; and
a rear wall inclining in a rearward direction when the sole plate is unflexed in a longitudinal direction of the sole plate.

9. The sole structure of claim 1, wherein:
the sole plate includes a first notch in a medial edge of the sole plate and a second notch in a lateral edge of the sole plate; and
the first notch and the second notch are aligned with the plurality of grooves.

10. The sole structure of claim 1, wherein each groove of the plurality of grooves has a medial end and a lateral end, with the lateral end rearward of the medial end.

11. The sole structure of claim 1, wherein the sole plate includes:
a first slot extending through the sole plate between a medial edge of the sole plate and a medial end of the plurality of grooves; and
a second slot extending through the sole plate between a lateral edge of the sole plate and a lateral end of the plurality of grooves.

12. The sole structure of claim 1, wherein the sole plate is at least one of a midsole plate, an outsole plate, or an insole plat.

13. A sole structure for an article of footwear comprising:
a sole plate that includes a foot-facing surface with a forefoot portion, and a ground-facing surface opposite from the foot-facing surface;
wherein the sole plate has:
a plurality of grooves extending lengthwise at least partially transversely relative to the sole plate across the foot-facing surface;
a plurality of ribs protruding at the ground-facing surface, extending at least partially transversely relative to the sole plate, and underlying the plurality of grooves;
a first slot extending through the sole plate between a medial edge of the sole plate and a medial end of the plurality of grooves; and
a second slot extending through the sole plate between a lateral edge of the sole plate and a lateral end of the plurality of grooves;
wherein:
at least some of the grooves are configured to be open when the forefoot portion of the sole structure is in an unflexed position, and closed when the forefoot portion of the sole structure is flexed in a longitudinal direction; and
the sole plate has a resistance to deformation in response to compressive forces applied across the at least some of the grooves, the sole structure thereby having a nonlinear bending stiffness with a change in bending stiffness when the at least some of the grooves close.

14. The sole structure of claim 13, wherein each rib of the plurality of ribs is coincident with a different respective groove of the plurality of grooves.

15. The sole structure of claim 13, wherein:

the sole plate has at least one flexion channel extending at least partially transversely relative to the sole plate at the ground-facing surface of the sole plate; and the at least one flexion channel is between an adjacent pair of ribs of the plurality of ribs.

16. The sole structure of claim 13, wherein:

the at least some of the grooves close when the sole structure is dorsiflexed at an angle between a first axis extending along a longitudinal midline of the sole plate at the ground-facing surface anterior to the plurality of grooves and a second axis extending along the longitudinal midline posterior to the plurality of grooves; and the at least some of the grooves close when the angle is an angle selected from the range of angles extending from 35 degrees to 65 degrees.

17. The sole structure of claim 13, wherein the sole plate has a resistance to deformation in response to compressive forces applied across the plurality of grooves when the plurality of grooves is closed.

18. The sole structure of claim 13, wherein adjacent walls of the sole plate at each groove of the plurality of grooves include:

a front wall inclining in a forward direction; and a rear wall inclining in a rearward direction when the sole plate is unflexed in the longitudinal direction of the sole plate.

19. The sole structure of claim 13, wherein:

the sole plate includes a first notch in a medial edge of the sole plate and a second notch in a lateral edge of the sole plate; and the first notch and the second notch are aligned with the plurality of grooves.

20. The sole structure of claim 13, wherein each groove of the plurality of grooves has a medial end and a lateral end, with the lateral end rearward of the medial end.

* * * * *